US009833120B2

(12) United States Patent
Vallejo Noriega et al.

(10) Patent No.: US 9,833,120 B2
(45) Date of Patent: Dec. 5, 2017

(54) HEATING AIR FOR DRYING DISHES IN A DISHWASHER USING AN IN-LINE WASH LIQUID HEATER

(71) Applicant: Whirlpool Corporation, Benton Harbor, MI (US)

(72) Inventors: Alvaro Vallejo Noriega, Saint Joseph, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 692 days.

(21) Appl. No.: 13/855,748

(22) Filed: Apr. 3, 2013

(65) Prior Publication Data

US 2013/0319482 A1 Dec. 5, 2013

Related U.S. Application Data

(63) Continuation-in-part of application No. 13/486,038, filed on Jun. 1, 2012, now Pat. No. 9,451,862.

(51) Int. Cl.

| | |
|---|---|
| ***A47L 15/42*** | (2006.01) |
| ***A47L 15/48*** | (2006.01) |
| *A47L 15/00* | (2006.01) |

(52) U.S. Cl.

CPC ..... *A47L 15/4285* (2013.01); *A47L 15/48* (2013.01); *A47L 15/0084* (2013.01); *A47L 15/4221* (2013.01); *A47L 15/488* (2013.01); *A47L 2401/023* (2013.01); *A47L 2401/12* (2013.01); *A47L 2401/18* (2013.01);

(Continued)

(58) Field of Classification Search

CPC .. A47L 15/23; A47L 15/4225; A47L 15/4221; A47L 15/4208; A47L 15/4282

USPC ..... 134/56 D, 25.2, 111, 58 D, 176, 57 D, 134/200, 179, 18, 186, 198, 178, 10; 239/251, 261, 264, 66, 227, 240, 243, 239/244; 137/625.11, 387, 627, 216, (Continued)

(56) References Cited

U.S. PATENT DOCUMENTS

| | | |
|---|---|---|
| 1,617,021 A | 2/1927 | Mitchell |
| 2,044,524 A | 6/1936 | Charles |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

German Search Report for Counterpart DE102013109125, dated Dec. 9, 2013.

(Continued)

*Primary Examiner* — Michael Barr
*Assistant Examiner* — Thomas Bucci
(74) *Attorney, Agent, or Firm* — McGarry Bair PC

(57) ABSTRACT

A dishwasher has a liquid supply system with a first conduit portion through which the liquid passes, and an air supply system with a second conduit portion through which the air passes. The first conduit portion at least partially forms the second conduit portion to define a thermal transfer interface. A heating system includes a heating element provided on the thermal transfer interface. Activation of the heating element provides heat to both the liquid supply system and the air supply system.

14 Claims, 19 Drawing Sheets

(52) U.S. Cl.
CPC ..... *A47L 2401/19* (2013.01); *A47L 2401/26* (2013.01); *A47L 2501/06* (2013.01); *A47L 2501/07* (2013.01); *A47L 2501/10* (2013.01); *A47L 2501/11* (2013.01); *A47L 2501/12* (2013.01); *A47L 2501/30* (2013.01)

(58) Field of Classification Search
USPC .... 137/625.21, 625.23; 165/95, 163, 104.13, 165/166, 181, 51
See application file for complete search history.

(56) References Cited

U.S. PATENT DOCUMENTS 2,154,559 A 4/1939 Bilde
2,422,022 A 6/1947 Koertge
2,726,666 A 12/1955 Oxford
2,734,122 A 2/1956 Flannery
3,016,147 A 1/1962 Cobb et al.
3,026,628 A 3/1962 Berger, Sr. et al.
3,064,664 A 11/1962 Warhus
3,068,877 A 12/1962 Jacobs
3,103,227 A 9/1963 Long
3,122,148 A 2/1964 Alabaster
3,186,417 A 6/1965 Fay
3,288,154 A 11/1966 Jacobs
3,310,243 A 3/1967 Duncan et al.
3,378,933 A 4/1968 Jenkins
3,542,594 A 11/1970 Smith et al.
3,575,185 A 4/1971 Barbulesco
3,586,011 A 6/1971 Mazza
3,708,120 A 1/1973 Camprubi et al.
3,709,236 A 1/1973 Field et al.
3,739,145 A 6/1973 Woehler
3,801,280 A 4/1974 Shah et al.
3,846,321 A 11/1974 Strange
3,906,967 A 9/1975 Bergeson
3,989,054 A 11/1976 Mercer
4,179,307 A 12/1979 Cau et al.
4,180,095 A 12/1979 Woolley et al.
4,228,962 A 10/1980 Dingler et al.
4,326,552 A 4/1982 Bleckmann
4,346,723 A 8/1982 Geiger
4,359,250 A 11/1982 Jenkins
4,374,443 A 2/1983 Mosell
4,528,097 A 7/1985 Ward
4,754,770 A 7/1988 Fornasari
5,002,890 A 3/1991 Morrison
5,030,357 A 7/1991 Lowe
5,131,419 A 7/1992 Roberts
5,133,863 A 7/1992 Zander
5,331,986 A 7/1994 Lim et al.
5,427,129 A 6/1995 Young et al.
5,454,298 A 10/1995 Lu
5,470,142 A 11/1995 Sargeant et al.
5,470,472 A 11/1995 Baird et al.
5,546,968 A 8/1996 Jeon et al.
5,557,704 A 9/1996 Dennis et al.
5,569,383 A 10/1996 Vander Ark, Jr. et al.
5,601,100 A 2/1997 Kawakami et al.
5,618,424 A 4/1997 Nagaoka
5,630,437 A 5/1997 Dries et al.
5,655,556 A 8/1997 Guerrera et al.
5,673,714 A 10/1997 Campagnolo et al.
5,711,325 A 1/1998 Kloss et al.
5,755,244 A 5/1998 Sargeant et al.
5,782,112 A 7/1998 White et al.
5,803,100 A 9/1998 Thies
5,865,997 A 2/1999 Isaacs
5,868,937 A 2/1999 Back et al.
5,904,163 A 5/1999 Inoue et al.
5,924,432 A 7/1999 Thies et al.
6,053,185 A 4/2000 Beevers
6,289,908 B1 9/2001 Kelsey
6,389,908 B1 5/2002 Chevalier et al.
6,443,091 B1 9/2002 Matte
6,460,555 B1 10/2002 Tuller et al.
6,491,049 B1 12/2002 Tuller et al.
6,601,593 B2 8/2003 Deiss et al.
6,666,976 B2 12/2003 Benenson, Jr. et al.
6,675,437 B1 * 1/2004 York ..... A47L 11/34 15/320
6,800,197 B1 10/2004 Kosola et al.
6,997,195 B2 2/2006 Durazzani et al.
7,047,986 B2 5/2006 Ertle et al.
7,069,181 B2 6/2006 Jerg et al.
7,093,604 B2 8/2006 Jung et al.
7,150,284 B2 12/2006 Aulbers et al.
7,153,817 B2 12/2006 Binder
7,198,054 B2 4/2007 Welch
7,208,080 B2 4/2007 Batten et al.
7,232,494 B2 6/2007 Rappette
7,250,174 B2 7/2007 Lee et al.
7,270,132 B2 9/2007 Inui et al.
7,319,841 B2 1/2008 Bateman, III et al.
7,326,338 B2 2/2008 Batten et al.
7,331,356 B2 2/2008 VanderRoest et al.
7,347,212 B2 3/2008 Rosenbauer
7,350,527 B2 4/2008 Gurubatham et al.
7,363,093 B2 4/2008 King et al.
7,406,843 B2 8/2008 Thies et al.
7,409,962 B2 8/2008 Welch
7,445,013 B2 11/2008 VanderRoest et al.
7,475,696 B2 1/2009 VanderRoest et al.
7,497,222 B2 3/2009 Edwards et al.
7,523,758 B2 4/2009 VanderRoest et al.
7,594,513 B2 9/2009 VanderRoest et al.
7,810,512 B2 10/2010 Pyo et al.
7,819,983 B2 10/2010 Kim et al.
7,896,977 B2 3/2011 Gillum et al.
8,038,802 B1 10/2011 Tuller
8,043,437 B1 10/2011 Delgado et al.
8,137,479 B2 3/2012 VanderRoest et al.
8,161,986 B2 4/2012 Alessandrelli
8,187,390 B2 5/2012 VanderRoest et al.
8,215,322 B2 7/2012 Fountain et al.
8,667,974 B2 3/2014 Fountain et al.
8,746,261 B2 6/2014 Welch
9,005,369 B2 4/2015 Delgado et al.
9,010,344 B2 4/2015 Tuller et al.
9,034,112 B2 5/2015 Tuller et al.
9,538,898 B2 1/2017 Tuller et al.
2002/0017483 A1 2/2002 Chesner et al.
2003/0037809 A1 2/2003 Favaro
2003/0168087 A1 9/2003 Inui et al.
2003/0205248 A1 11/2003 Christman et al.
2004/0007253 A1 1/2004 Jung et al.
2004/0103926 A1 6/2004 Ha
2004/0254654 A1 12/2004 Donnelly et al.
2005/0022849 A1 2/2005 Park et al.
2005/0133070 A1 6/2005 Vanderroest et al.
2006/0005863 A1 1/2006 Gurubatham et al.
2006/0042657 A1 3/2006 Welch
2006/0054549 A1 3/2006 Schoendorfer
2006/0123563 A1 6/2006 Raney et al.
2006/0162744 A1 7/2006 Walkden
2006/0174915 A1 8/2006 Hedstrom et al.
2006/0236556 A1 10/2006 Ferguson et al.
2006/0237049 A1 10/2006 Weaver et al.
2006/0237052 A1 10/2006 Plcardat et al.
2007/0006898 A1 1/2007 Lee
2007/0107753 A1 5/2007 Jerg
2007/0119478 A1 5/2007 King et al.
2007/0124004 A1 5/2007 King et al.
2007/0163626 A1 7/2007 Klein
2007/0186964 A1 8/2007 Mason et al.
2007/0246078 A1 10/2007 Purtilo et al.
2007/0266587 A1 11/2007 Bringewatt et al.
2007/0295360 A1 12/2007 Jerg et al.
2008/0116135 A1 5/2008 Rieger et al.
2008/0190464 A1 8/2008 Stahlmann et al.
2008/0289654 A1 11/2008 Kim et al.
2008/0289664 A1 11/2008 Rockwell et al.
2009/0095330 A1 4/2009 Iwanaga et al.
2009/0101182 A1 4/2009 Buesing et al.

(56) References Cited

U.S. PATENT DOCUMENTS

| | | | |
|---|---|---|---|
| 2009/0283111 | A1 | 11/2009 | Classen et al. |
| 2010/0012159 | A1 | 1/2010 | Verma et al. |
| 2010/0043826 | A1 | 2/2010 | Bertsch et al. |
| 2010/0043828 | A1 | 2/2010 | Choi et al. |
| 2010/0043847 | A1 | 2/2010 | Yoon et al. |
| 2010/0121497 | A1 | 5/2010 | Heisele et al. |
| 2010/0147339 | A1 | 6/2010 | Bertsch et al. |
| 2010/0154830 | A1 | 6/2010 | Lau et al. |
| 2010/0154841 | A1 | 6/2010 | Fountain et al. |
| 2010/0175762 | A1 | 7/2010 | Anacrelico |
| 2010/0224223 | A1 | 9/2010 | Kehl et al. |
| 2010/0252081 | A1 | 10/2010 | Classen et al. |
| 2010/0300499 | A1 | 12/2010 | Han et al. |
| 2011/0030742 | A1 | 2/2011 | Dalsing et al. |
| 2011/0061682 | A1 | 3/2011 | Fountain et al. |
| 2011/0120508 | A1 | 5/2011 | Yoon et al. |
| 2011/0126865 | A1 | 6/2011 | Yoon et al. |
| 2011/0146714 | A1 | 6/2011 | Fountain et al. |
| 2011/0146730 | A1 | 6/2011 | Welch |
| 2011/0146731 | A1 | 6/2011 | Fountain et al. |
| 2011/0214702 | A1 | 9/2011 | Brown-West et al. |
| 2011/0240070 | A1 | 10/2011 | Fadler et al. |
| 2012/0097200 | A1 | 4/2012 | Fountain |
| 2012/0118330 | A1 | 5/2012 | Tuller et al. |
| 2012/0118336 | A1 | 5/2012 | Welch |
| 2012/0138096 | A1 | 6/2012 | Tuller et al. |
| 2012/0138106 | A1 | 6/2012 | Fountain et al. |
| 2012/0138107 | A1* | 6/2012 | Fountain ..... A47L 15/0084 134/111 |
| 2012/0291805 | A1 | 11/2012 | Tuller et al. |
| 2012/0291822 | A1 | 11/2012 | Tuller et al. |
| 2012/0318295 | A1 | 12/2012 | Delgado et al. |
| 2012/0318296 | A1 | 12/2012 | Fountain et al. |
| 2012/0318308 | A1 | 12/2012 | Fountain et al. |
| 2012/0318309 | A1 | 12/2012 | Tuller et al. |
| 2013/0186437 | A1 | 7/2013 | Tuller et al. |
| 2013/0186438 | A1 | 7/2013 | Fountain et al. |
| 2013/0220386 | A1 | 8/2013 | Jozwiak |
| 2013/0319481 | A1 | 12/2013 | Welch |
| 2013/0319482 | A1 | 12/2013 | Noriega et al. |
| 2013/0319483 | A1 | 12/2013 | Welch |
| 2013/0319485 | A1 | 12/2013 | Blanchard et al. |
| 2014/0109938 | A1 | 4/2014 | Geda et al. |
| 2014/0130829 | A1 | 5/2014 | Fountain et al. |
| 2014/0230852 | A1 | 8/2014 | Tuller et al. |
| 2014/0238446 | A1 | 8/2014 | Welch et al. |
| 2014/0332040 | A1 | 11/2014 | Geda |

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | A1 | 10/1991 |
| DE | 4016915 | A1 | 11/1991 |
| DE | 4131914 | A1 | 4/1993 |
| DE | 4236931 | A1 | 5/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | A1 | 6/2011 |
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0524102 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 0752231 | A1 | 1/1997 |
| EP | 752231 | A1 | 1/1997 |
| EP | 0854311 | A2 | 7/1998 |
| EP | 0855165 | A2 | 7/1998 |
| EP | 0898928 | A1 | 3/1999 |
| EP | 0943281 | A2 | 9/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1277430 | A1 | 1/2003 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1728913 | A2 | 12/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| EP | 2335547 | A1 | 6/2011 |
| EP | 2338400 | A1 | 6/2011 |
| EP | 2351507 | A1 | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |

(56) References Cited

FOREIGN PATENT DOCUMENTS

| | | | |
|---|---|---|---|
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | A | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 9164107 | A | 6/1997 |
| JP | 10109007 | A | 4/1998 |
| JP | 10243910 | A | 9/1998 |
| JP | 11076127 | A | 3/1999 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004113683 | A | 4/2004 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| JP | 5184514 | B2 | 4/2013 |
| KR | 20010077128 | | 8/2001 |
| KR | 20060029567 | A | 4/2006 |
| KR | 20090006659 | | 1/2009 |
| KR | 20090061479 | A1 | 6/2009 |
| KR | 20100037453 | A | 4/2010 |
| WO | 2005058124 | A1 | 6/2005 |
| WO | 2005060813 | A1 | 7/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |
| WO | 2010073185 | A1 | 7/2010 |

OTHER PUBLICATIONS

European Search Report for EP11188106, dated Mar. 29, 2012.
German Search Report for DE102010061347, dated Jan. 23, 2013.
German Search Report for DE102010061215, dated Feb. 7, 2013.
German Search Report for DE102010061346, dated Sep. 30, 2011.
German Search Report for DE102010061343, dated Jul. 7, 2011.
German Search Report for DE102011053666, dated Oct. 21, 2011.
German Search Report for DE102010061342, dated Aug. 19, 2011.
European Search Report for EP101952380, dated May 19, 2011.
European Search Report for EP12188007, dated Aug. 6, 2013.
German Search Report for DE102013103264, dated Jul. 12, 2013.
German Search Report for DE102013103625, dated Jul. 19, 2013.
Ishihara et al., JP 11155792 A, English Machine Translation, 1999, pp. 1-14.
German Search Report for Counterpart DE102014101260.7, dated Sep. 18, 2014.
European Search Report for EP121914675, dated Dec. 5, 2012.
German Search Report for DE1020141017242, dated Apr. 26, 2016.

* cited by examiner

HEATING AIR FOR DRYING DISHES IN A DISHWASHER USING AN IN-LINE WASH LIQUID HEATER

CROSS-REFERENCE TO RELATED APPLICATION

This application is a continuation of U.S. application Ser. No. 13/855,748, filed Apr. 3, 2013, now U.S. Pat. No. 9,451,862 which is incorporated herein by reference in its entirety.

BACKGROUND OF THE INVENTION

Contemporary automatic dishwashers for use in a typical household include a tub for receiving soiled dishes to be cleaned. A spray system and a recirculation system may be provided for re-circulating liquid throughout the tub to remove soils from the dishes. The dishwasher may have a controller that implements a number of pre-programmed cycles of operation to wash dishes contained in the tub.

SUMMARY OF THE INVENTION

A dishwasher has a liquid supply system with a first conduit portion through which the liquid passes, and an air supply system with a second conduit portion through which the air passes. The first conduit portion at least partially forms the second conduit portion to define a thermal transfer interface. A heating system includes a heating element provided on the thermal transfer interface. Activation of the heating element provides heat to both the liquid supply system and the air supply system.

DESCRIPTION OF EMBODIMENTS OF THE INVENTION

Figure 1:
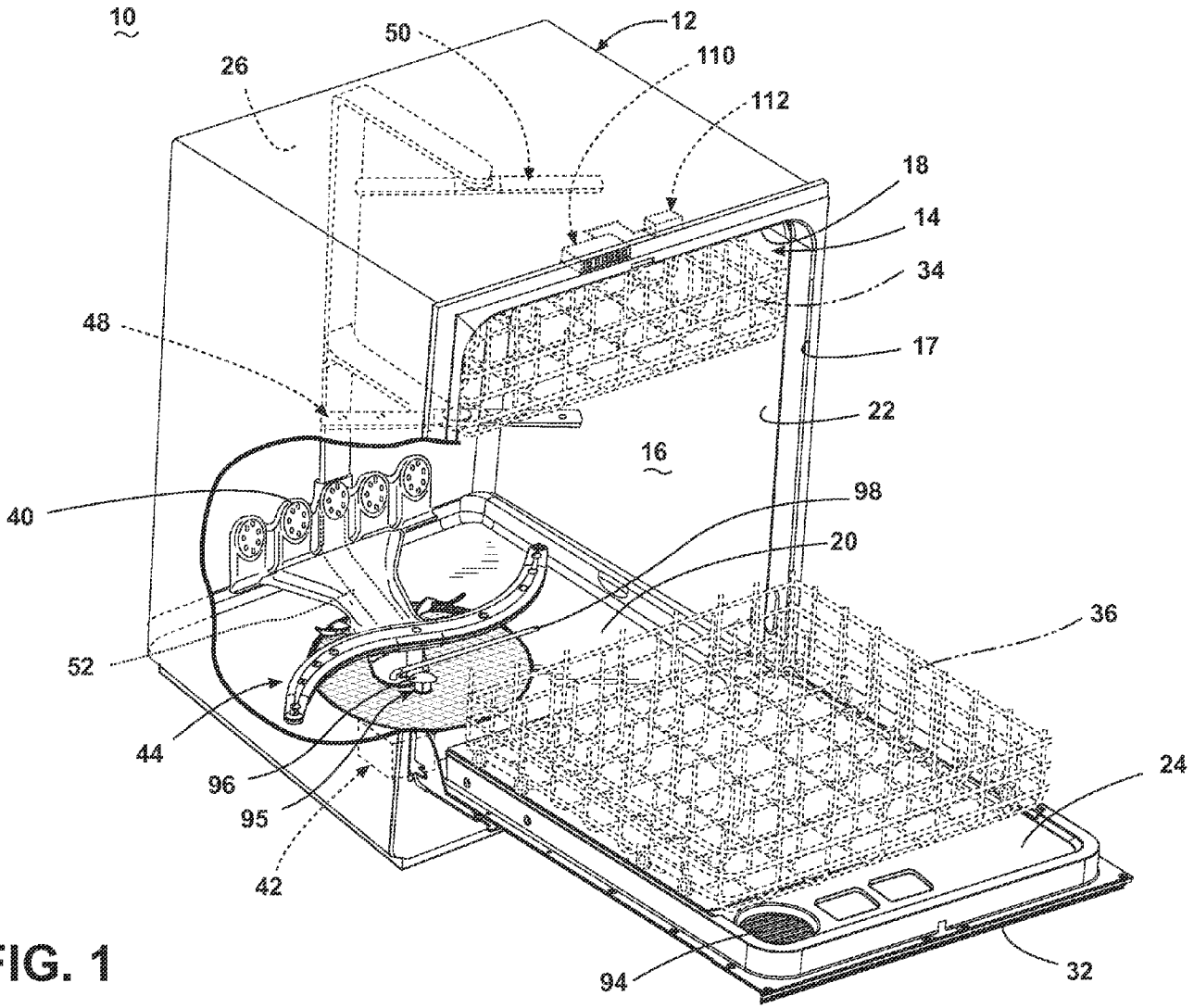
FIG. 1 is a perspective view of a dishwasher in accordance with a first embodiment of the invention.

Referring to FIG. 1, a first embodiment of the invention is illustrated as a dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention.

The cabinet 12 encloses a tub 14 at least partially defining a treating chamber 16 for holding dishes for washing according to a cycle of operation and defining an access opening 17. The tub 14 has spaced top and bottom walls 18 and 20, spaced sidewalls 22, a front wall 24, and a rear wall 26. In this configuration, the walls 18, 20, 22, 24, and 26 collectively define the treating chamber 16 for treating or washing dishes. The bottom wall 20 may have a front lip 28 (FIG. 2) with an upper portion 30 that may define a portion of the access opening 17. The front wall 24 may be at least partially defined by a door 32 of the dishwasher 10, which may be pivotally attached to the dishwasher 10 for providing accessibility to the treating chamber 16 through the access opening 17 for loading and unloading dishes or other washable items. More specifically, the door 32 may be configured to selectively open and close the access opening 17.

Dish holders in the form of upper and lower dish racks 34, 36 are located within the treating chamber 16 and receive dishes for washing. The upper and lower racks 34, 36 may be mounted for slidable movement in and out of the treating chamber 16 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While the present invention is described in terms of a conventional dishwashing unit as illustrated in FIG. 1, it could also be implemented in other types of dishwashing units such as in-sink dishwashers or drawer dishwashers including drawer dishwashers having multiple compartments.

Figure 2:
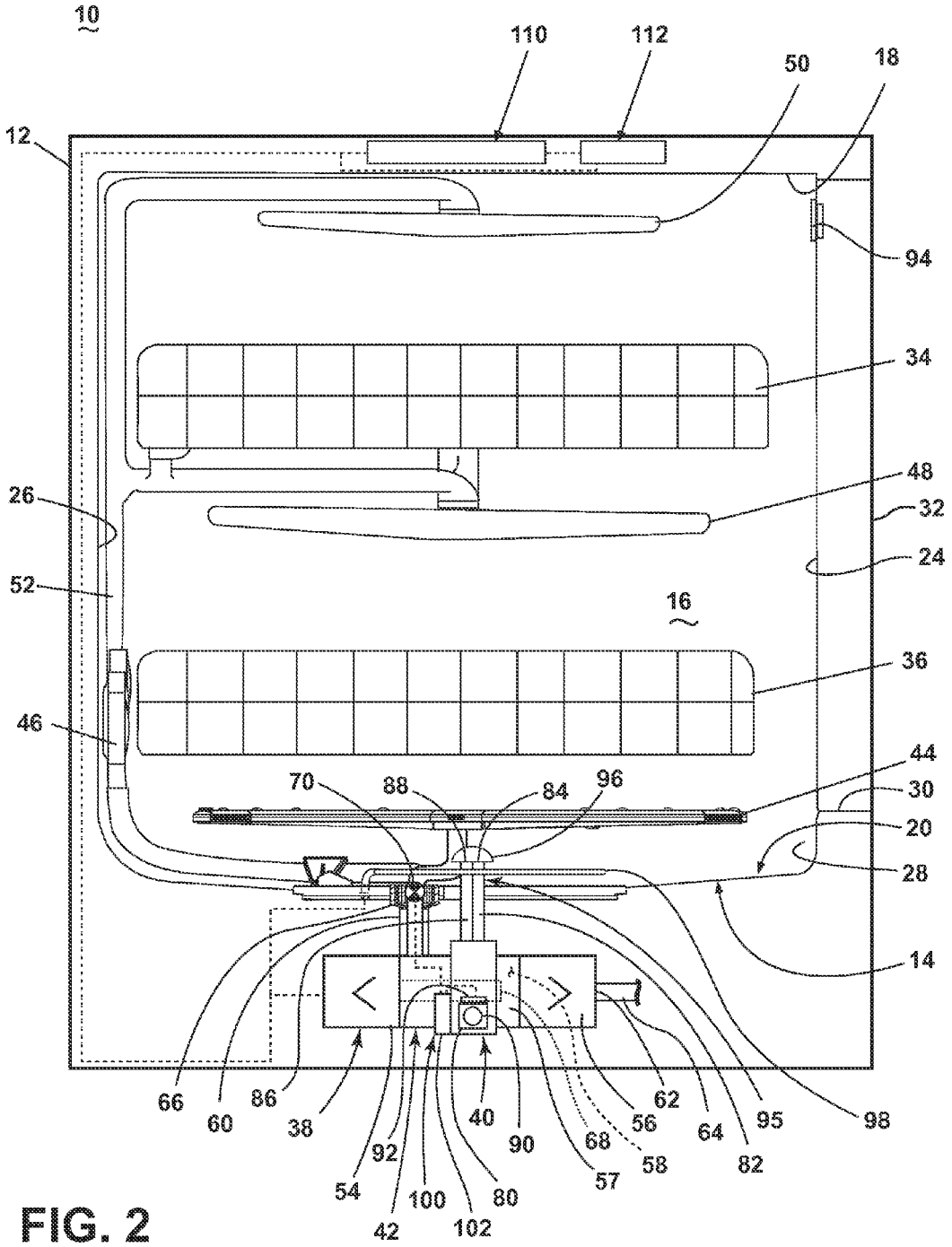
FIG. 2 is a partial schematic cross-sectional view of the dishwasher shown in FIG. 1 and illustrating a recirculation system and air supply system.

Referring to FIG. 2, the major systems of the dishwasher 10 and their interrelationship may be seen. For example, a liquid recirculation system 38 is provided for spraying liquid within the treating chamber 16 to treat any dishes located therein and an air supply system 40 is provided for supplying air to the treating chamber 16 for aiding in the drying of the dishes. The recirculation system may include a remote sump and filter unit 42 that is operably coupled to the liquid recirculation system 38 and the air supply system 40. Among other things, the remote sump and filter unit 42 may provide pumping and filtering for the liquid recirculation system 38, a heating function for the both the liquid recirculation system 38 and the air supply system 40, and a draining function.

The liquid recirculation system 38 may include one or more sprayers for spraying liquid within the treating chamber 16 and defines a recirculation flow path for recirculating the sprayed liquid from the treating chamber 16 to the one or more sprayers. As illustrated, there are four sprayers: a first lower spray assembly 44, a second lower spray assembly 46, a mid-level spray assembly 48, and an upper spray assembly 50, which may be supplied liquid from a supply tube 52. The first lower spray assembly 44 is positioned above the bottom wall 20 and beneath the lower dish rack 36. The first lower spray assembly 44 is an arm configured to rotate in the wash tub 14 and spray a flow of liquid from a plurality of spray nozzles or outlets, in a primarily upward direction, over a portion of the interior of the wash tub 14. A first wash zone may be defined by the spray field emitted by the first lower spray assembly 44 into the treating chamber 16. The spray from the first lower spray assembly 44 is sprayed into the wash tub 14 in typically upward fashion to wash dishes located in the lower dish rack 36. The first lower spray assembly 44 may optionally also provide a liquid spray downwardly onto a lower portion of the treating chamber 16, but for purposes of simplification, this will not be illustrated or described herein.

The second lower spray assembly 46 is illustrated as being located adjacent the lower rack 36 toward the rear of the treating chamber 16. The second lower spray assembly 46 is illustrated as including a horizontally oriented distribution header or spray manifold having a plurality of nozzles. The second lower spray assembly 46 may not be limited to this position; rather, the second lower spray assembly 46 could be located in virtually any part of the treating chamber 16. Alternatively, the second lower spray assembly 46 could be positioned underneath the lower rack 36, adjacent or beneath the first lower spray assembly 44. Such a spray manifold is set forth in detail in U.S. Pat. No. 7,594,513, issued Sep. 29, 2009, and titled "Multiple Wash Zone Dishwasher," which is incorporated herein by reference in its entirety. The second lower spray assembly 46 may be configured to spray a flow of treating liquid in a generally lateral direction, over a portion of the interior of the treating chamber 16. The spray may be typically directed to treat dishes located in the lower rack 36. A second wash zone may be defined by the spray field emitted by the second lower spray assembly 46 into the treating chamber 16. When both the first lower spray assembly 44 and the second lower spray assembly 46 emit spray fields the first and second zones may intersect.

The mid-level spray arm assembly 48 is positioned between the upper dish rack 34 and the lower dish rack 36. Like the first lower spray assembly 44, the mid-level spray assembly 48 may also be configured to rotate in the dishwasher 10 and spray a flow of liquid in a generally upward direction, over a portion of the interior of the wash tub 14. In this case, the spray from the mid-level spray arm assembly 48 is directed to dishes in the upper dish rack 34 to define a third spray zone. In contrast, the upper spray arm assembly 50 is positioned above the upper dish rack 34 and generally directs a spray of liquid in a generally downward direction to define a fourth spray zone that helps wash dishes on both upper and lower dish racks 34, 36.

The remote sump and filter unit 42 may include a wash or recirculation pump 54 and a drain pump 56, which are fluidly coupled to a housing 57 defining a sump 58, where liquid sprayed into the wash tub 14 will collect due to gravity. As illustrated, the housing 57 is physically separate from the wash tub 14 and provides a mounting structure for the recirculation pump 54 and drain pump 56. An inlet conduit 60 fluidly couples the wash tub 14 to the housing 57 and provides a path for the liquid in the treating chamber 16 to travel to the sump 58. As illustrated, the recirculation pump 54 fluidly couples the sump 58 to the supply tube 52 to effect a supplying of the liquid from the sump 58 to the sprayers. As illustrated, the drain pump 56 fluidly couples to a drain pump outlet 62 to effect a supplying of liquid from the sump to a household drain 64.

It is contemplated that multiple supply tubes 52 may be included within the dishwasher 10 and that one or more valves may be provided with the recirculation flow path to control the flow of liquid within the dishwasher 10. Liquid may be selectively supplied to a subset of all of the sprayers and/or simultaneously to all of the sprayers. The inlet conduit 60, sump 58, recirculation pump 54, spray assemblies 44-50, and supply tube(s) 52 collectively form a recirculation flow path in the liquid recirculation system 38. It will be understood that the recirculation flow path includes multiple recirculation circuits, with one of the circuits coupled to at least one of the sprayers forming the spray assemblies 44-50. One or more valves or diverters, shown schematically as liquid diverter 70, may be included in the dishwasher 10 to control the flow of liquid to the spray assemblies 44-50 from the recirculation pump 54. The liquid diverter 70 is provided within the recirculation flow path and is operable to select between at least two of the multiple circuits for inclusion in the recirculation flow path. In this manner, the liquid diverter 70 may direct liquid from the recirculation pump 54 to include in the recirculation flow path at least one of the multiple sprayers forming the spray assemblies 44-50.

A filter may be located somewhere within the liquid flow path such that soil and foreign objects may be filtered from the liquid. As an example, a filter 66 has been illustrated as being located inside the inlet conduit 60 such that soil and debris may be filtered from the liquid as it travels from an opening in the bottom wall 20 to the sump 58. The filter 66 may be a strainer, which may be employed to retain larger soil particles but allows smaller particles to pass through. An optional filter element 68 has been illustrated in FIG. 2 as being located within the housing 57 between the inlet conduit 60 and the recirculation pump 54.

The recirculation pump 54 may be fluidly coupled to the recirculation path such that it draws liquid in through the inlet conduit 60 and sump 58 and delivers it to one or more of the spray assemblies 44-50 through the supply tube(s) 52 depending on the operation of the liquid diverter 70. The liquid is sprayed back into the treating chamber 16 through the spray assemblies 44-50 and drains back to the sump 58 where the process may be repeated.

The drain pump 56 may also be fluidly coupled to the housing 57. The drain pump 56 may be adapted to draw liquid from the housing 57 and to pump the liquid through a drain pump outlet 62 to a household drain 64. As illustrated, the dishwasher 10 includes a recirculation pump 54 and a drain pump 56. Alternatively, it is possible for the two pumps to be replaced by a single pump, which may be operated to supply to either the household drain or to the recirculation system.

The air supply system 40 may include a fan or blower 80, an air supply conduit 82 having an outlet 84 and an air return conduit 86 having an inlet 88. The blower 80 may be fluidly coupled with the air supply conduit 82 to supply air to the treating chamber 16 from the blower 80 as well as being fluidly coupled to the air return conduit 86 to draw air from the treating chamber 16. Thus, the air supply conduit 82 may be configured to provide air to the treating chamber 16 while the air return conduit 86 may be configured to remove air from the treating chamber 16.

The air supply conduit 82 and the air return conduit 86 are illustrated as being included in a standpipe 95 that extends through the bottom wall 20 of the tub into the treating chamber. A cover 96 or other means may be used to inhibit the entrance of sprayed liquid into the air supply conduit 82 and the air return conduit 86 by shielding the air supply conduit outlet 84 and the air return conduit inlet 88. While the air supply conduit 82 and the air return conduit 86 are illustrated as being located in the center of the bottom wall 20 and extending into the treating chamber 16 it is contemplated that they may be suitably located anywhere in the tub 14.

The air supply system may also include an inlet located below the bottom wall 20 such that air exterior to the tub 14, i.e., "ambient air", may be provided to the treating chamber 16. In this manner the blower 80 includes a first inlet open to air in the dishwasher 10, which is the air return conduit inlet 88 and a second inlet open to ambient air, which is the inlet.

The blower 80 includes a selectively positionable blower shutter 92, which may control a ratio of air from the air return conduit inlet 88 and the inlet to the treating chamber 16. The blower shutter 92 may be controlled such that the ratio of air from the inlet and air from the air return conduit 86 may be controlled. In this manner, the blower 80 may be fluidly coupled to the inlet, as well as the air supply conduit 82 and the air return conduit 86 and the blower shutter 92 may control the ratio of the recirculated air and the ambient air provided to the treating chamber through the air supply conduit 82.

Further, the air supply system 40 may include an outlet fluidly open to ambient air. An example of such an outlet has been illustrated as a vent 94, which may exhaust the supplied air from the treating chamber 16. The vent 94 may be fluidly coupled to an outlet duct (not shown), which vents into the interior of the door 32, allowing air to escape through the various openings in the door 32.

A drive system 100 having a single motor 102 has also been illustrated and may be operably coupled to the liquid diverter 70 and the blower shutter 92 to control the position of the liquid diverter 70 and the position of the blower shutter 92. The drive system 100 may independently control the position of the liquid diverter 70 and the position of the blower shutter 92. Alternatively, the control of the position of the liquid diverter 70 and the position of the blower shutter 92 by the drive system 100 may be linked or related in some manner.

A heater 98 may be located in the treating chamber 16 near the bottom wall 20 to heat liquid in the treating chamber 16. Alternatively, or in addition to the heater 98, a heater 140 (FIG. 5) may be located on the housing 57 and the heater 140 may be configured to heat air in the air supply system 40 and the liquid in the liquid recirculation system 38, as hereinafter described.

A control panel or user interface 110 provided on the dishwasher 10 and coupled to a controller 112 may be used to select a cycle of operation. The user interface 110 may be provided on the cabinet 12 or on the outer panel of the door 32 and can include operational controls such as dials, lights, switches, and displays enabling a user to input commands to the controller 112 and receive information about the selected cycle of operation. The dishwasher 10 may further include other conventional components such as additional valves, a dispensing system for dispensing treating chemistries or rinse aids, spray arms or nozzles, etc.; however, these components are not germane to the present invention and will not be described further herein.

Figure 3:
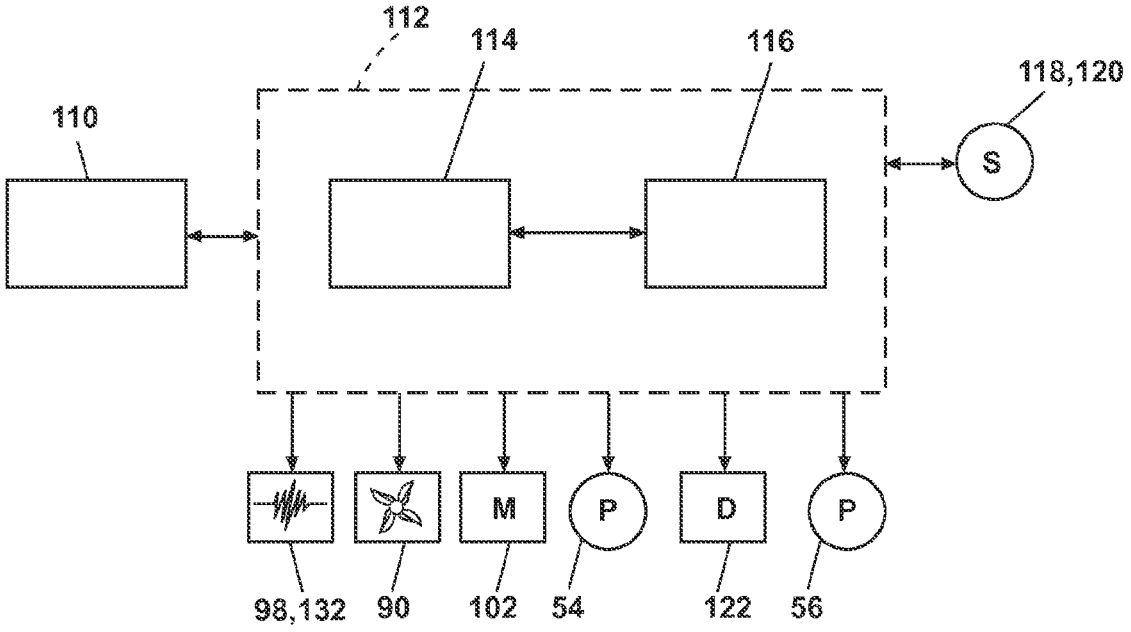
FIG. 3 is a schematic view of a control system of the dishwasher of FIG. 1.

As illustrated in FIG. 3, the controller 112 may be provided with a memory 114 and a central processing unit (CPU) 116. The memory 114 may be used for storing control software that may be executed by the CPU 116 in completing a cycle of operation using the dishwasher 10 and any additional software. For example, the memory 114 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 112 may be operably coupled with one or more components of the dishwasher 10 for communicating with and controlling the operation of the components to complete a cycle of operation. For example, the controller 112 may be coupled with the recirculation pump 54 for circulation of liquid in the wash tub 14 and the drain pump 56 for drainage of liquid in the wash tub 14. The controller 112 may also be operably coupled with the blower 80 and the blower shutter 92 to provide air into the wash tub 14.

Further, the controller 112 may also be coupled with one or more temperature sensors 118, which are known in the art and not shown for simplicity, such that the controller 112 may control the duration of the steps of the cycle of operation based upon the temperature detected. The controller 112 may also receive inputs from one or more other optional sensors 120, which are known in the art and not shown for simplicity. Non-limiting examples of optional sensors 120 that may be communicably coupled with the controller 112 include a moisture sensor, a door sensor, a detergent and rinse aid presence/type sensor(s), and a portion sensor. The controller 112 may also be coupled to a dispenser 122, which may dispense a detergent during the wash step of the cycle of operation or a rinse aid during the rinse step of the cycle of operation.

Figure 4:
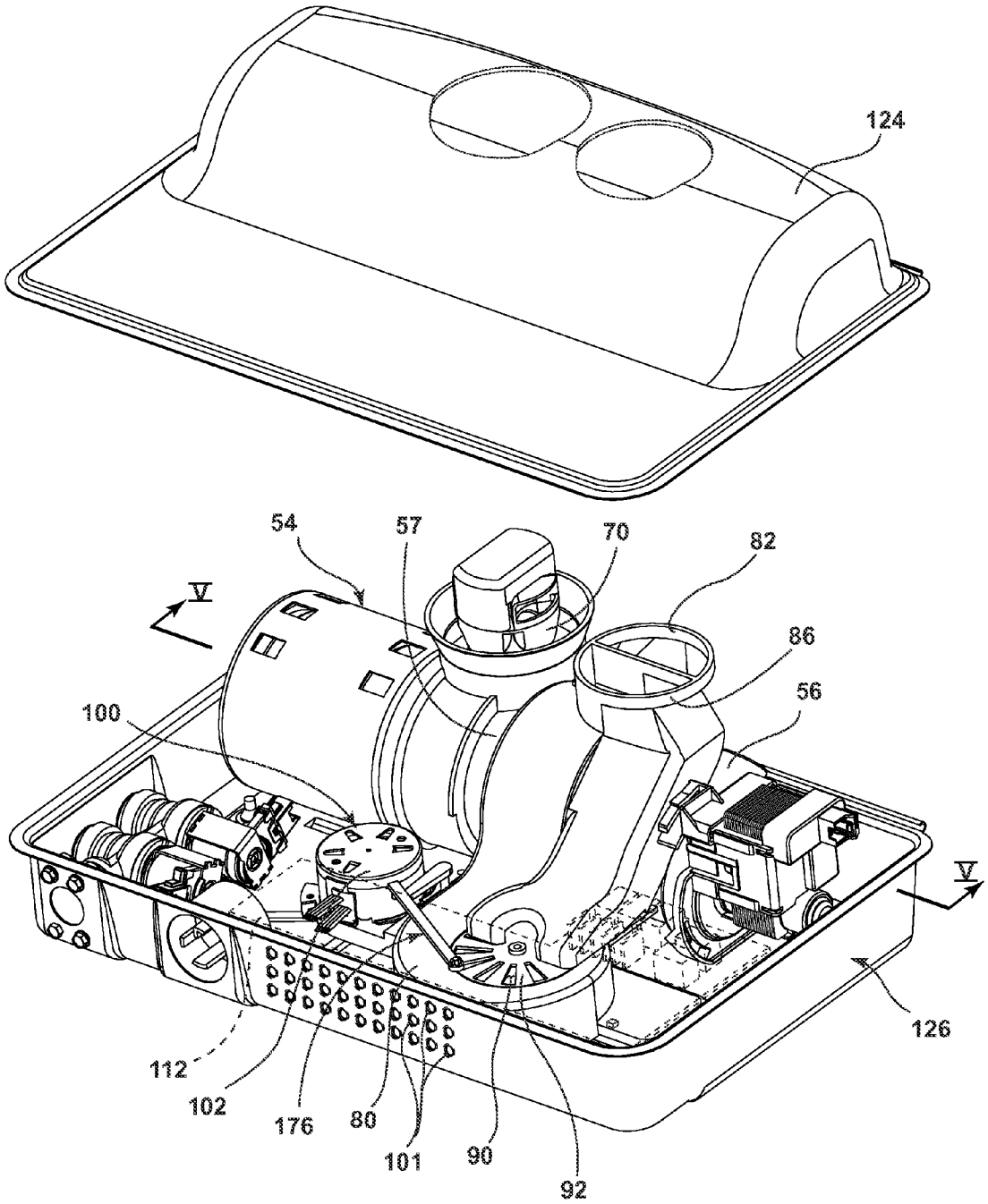
FIG. 4 is a perspective view of one embodiment of a remote sump and filter unit and its couplings to the recirculation system and air supply system illustrated in FIG. 2.

FIG. 4 illustrates a perspective view of one embodiment of the remote sump and filter unit 42. A cover 124 of the remote sump and filter unit 42 has been exploded from the remainder of the remote sump and filter unit 42 for clarity. The cover 124 may be mounted to a bottom 126 containing the remote sump and filter unit 42 in any suitable manner. The bottom 126 may include louvers or openings 101 to allow ambient air into the container formed by the bottom 126 and the cover 124.

The remote sump and filter unit 42 has a drain pump 56 and recirculation pump 54 mounted to the housing 57.

Portions of the air supply system 40 wrap around the housing 57. It will be understood that only a portion of both the air supply conduit 82 and the air return conduit 86 are illustrated and that the remainder of the standpipe 95 has not been illustrated.

Figure 5:
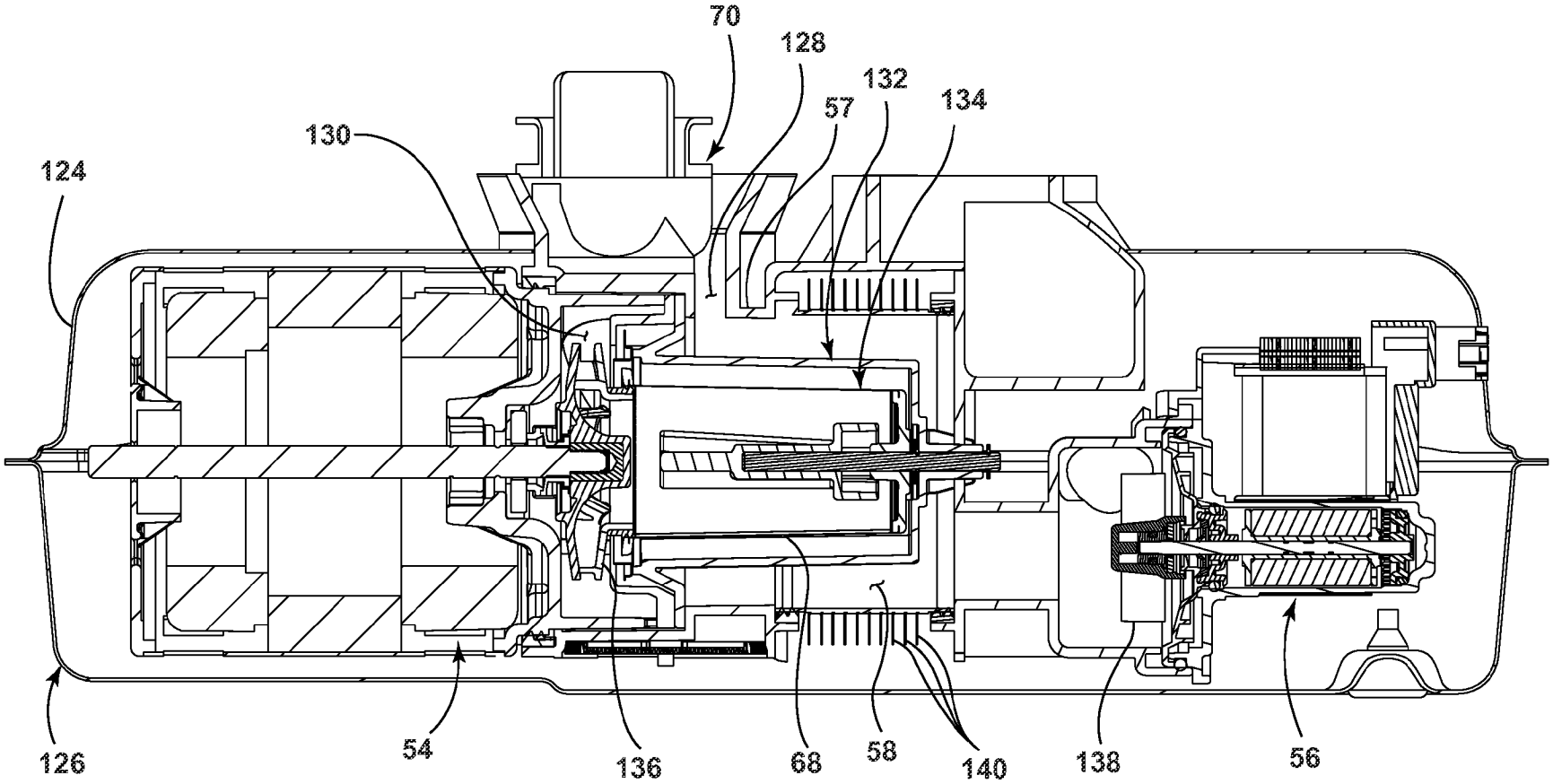
FIG. 5 is a cross-sectional view of the remote sump and filter unit of FIG. 4.

Referring to FIG. 5, a filter element 68 may be located in the housing 57 and fluidly disposed between the housing inlet 128 and housing outlet 130 to filter liquid passing through the sump 58. Because the housing 57 is located within the cabinet 12 but physically remote from the wash tub 14, the filter element 68 is not directly exposed to the wash tub 14. In this manner, the housing 57 and filter element 68 may be thought of as defining a filter unit, which is separate and remote from the wash tub 14. The filter element 68 may be a fine filter, which may be utilized to remove smaller particles from the liquid. The filter element 68 may be a rotating filter utilizing a shroud 132 and a first diverter 134 to aid in keeping the filter element 68 clean, such a rotating filter element 68 and additional elements such as the shroud 132 and diverter 134 are set forth in detail in U.S. patent application Ser. No. 13/483,254, filed May 30, 2012, and titled "Rotating Filter for a Dishwasher," which is incorporated herein by reference in its entirety. The rotating filter according to U.S. patent application Ser. No. 13/483,254 may be operably coupled to an impeller 136 of the recirculation pump 54 such that when the impeller 136 rotates the filter element 68 is also rotated.

The drain pump 56 may also be fluidly coupled to the housing 57. The drain pump 56 includes an impeller 138 which may draw liquid from the housing 57 and pump it through a drain pump outlet 62 to a household drain 64 (FIG. 2). The filter element 68 is not fluidly disposed between the housing inlet 128 and the drain pump outlet 62 such that unfiltered liquid may be removed from the sump 58.

The housing 57 has been illustrated as being located inside a portion of the air supply system 40. The heater 140 may be operably coupled to the controller 112 and may be positioned such that it is mounted to the housing 57 and shared by the liquid recirculation system 38 and the remote sump and filter unit 42. More specifically, it has been illustrated that the heater 140 is mounted to an exterior of the housing 57 where the air supply system 40 wraps around the housing 57. In this location, the heater 140 may provide heated air and heated liquid into the wash tub 14 at the same time or may provide heated air and heated liquid into the wash tub 14 separately. Alternatively, it has been contemplated that the heater 140 may be mounted to an interior of the housing 57 or that portions of the heater 140 could be mounted on both the interior and the exterior of the housing 57. Any suitable heater may be used for the heater 140 including a coiled heater, multiple ring heater, or a film heater mounted on the housing 57, which has been illustrated by way of example.

Figure 6:
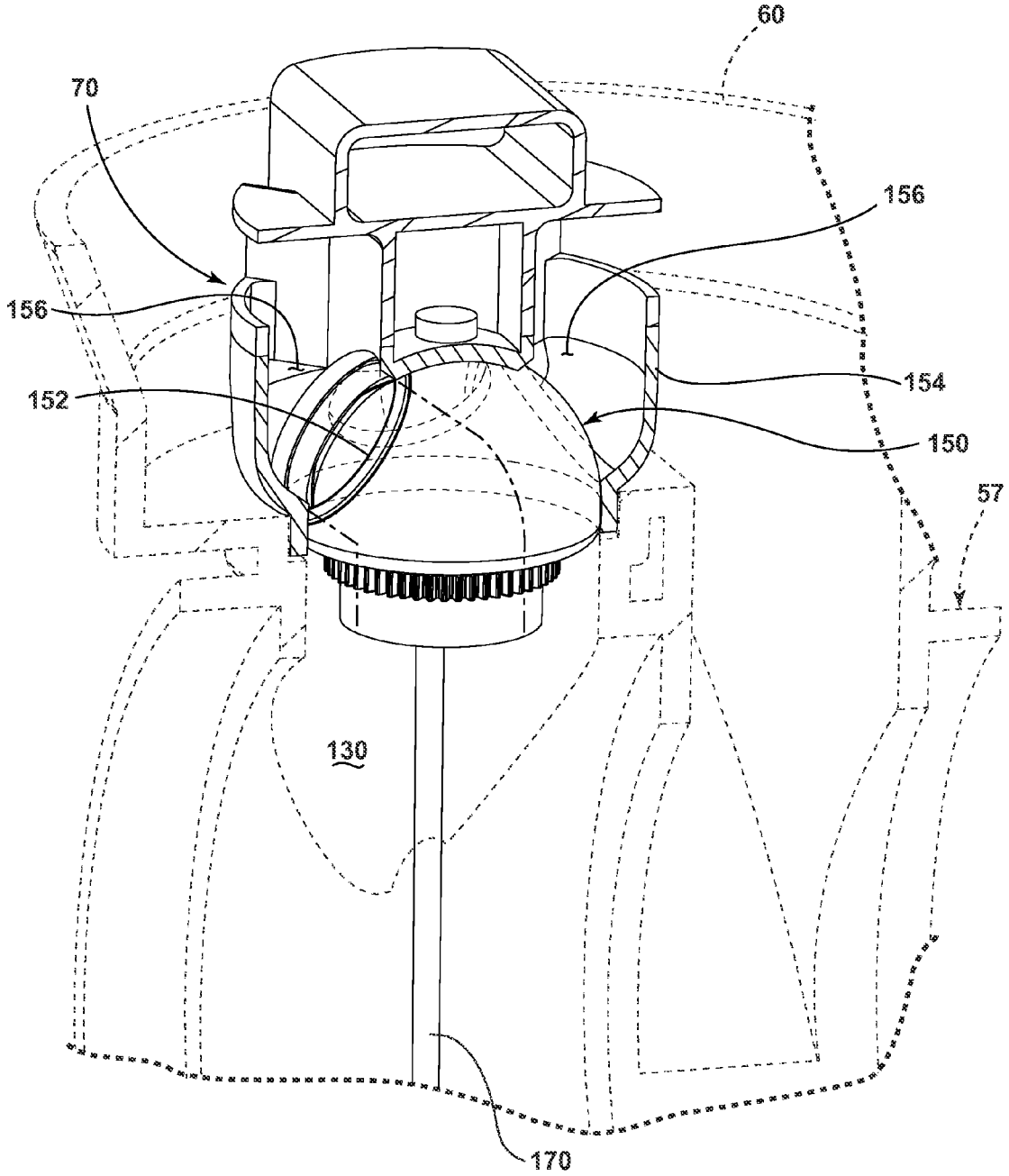
FIG. 6 is a cross-sectional view of a diverter of the remote sump and filter unit of FIG. 4.

The liquid diverter 70 has been better illustrated in FIG. 6 and, as illustrated, includes a hemispherical seal 150 having a single opening 152 to control the flow of liquid from the recirculation pump 54 to at least one of the multiple circuits in the recirculation flow path. It will be understood that any suitable liquid diverter 70 may be used including a diverter valve; such a diverter valve may have any number of outlets to diverter liquid to at least one of the multiple circuits in the recirculation flow path. Yet another example, of a suitable liquid diverter 70 may include a rotatable diverter disk such as set forth in detail in U.S. patent application Ser. No. 12/908,915, filed Oct. 21, 2010, and titled "Dishwasher with Controlled Rotation of Lower Spray Arm," which is incorporated herein by reference in its entirety.

In the illustrated embodiment and by way of example only, the multiple circuits are at least partially defined by a recirculation manifold 154 having multiple outlets 156. Each of the multiple outlets 156 may be operably coupled to, for example, each of the spray assemblies 44-50, respectively such that each of the multiple outlets 156 may direct liquid from the recirculation pump 54 to one of the multiple sprayers. The single opening 152 of the hemispherical seal 150 is dimensioned such that it may align with one of the multiple outlets 156 to selectively control a flow of liquid to one of the multiple outlets 156 for its inclusion in the recirculation flow path. It has been contemplated that the hemispherical seal 150 may be more than one opening and that the recirculation manifold 154 may have any number of outlets 156.

Figure 7:
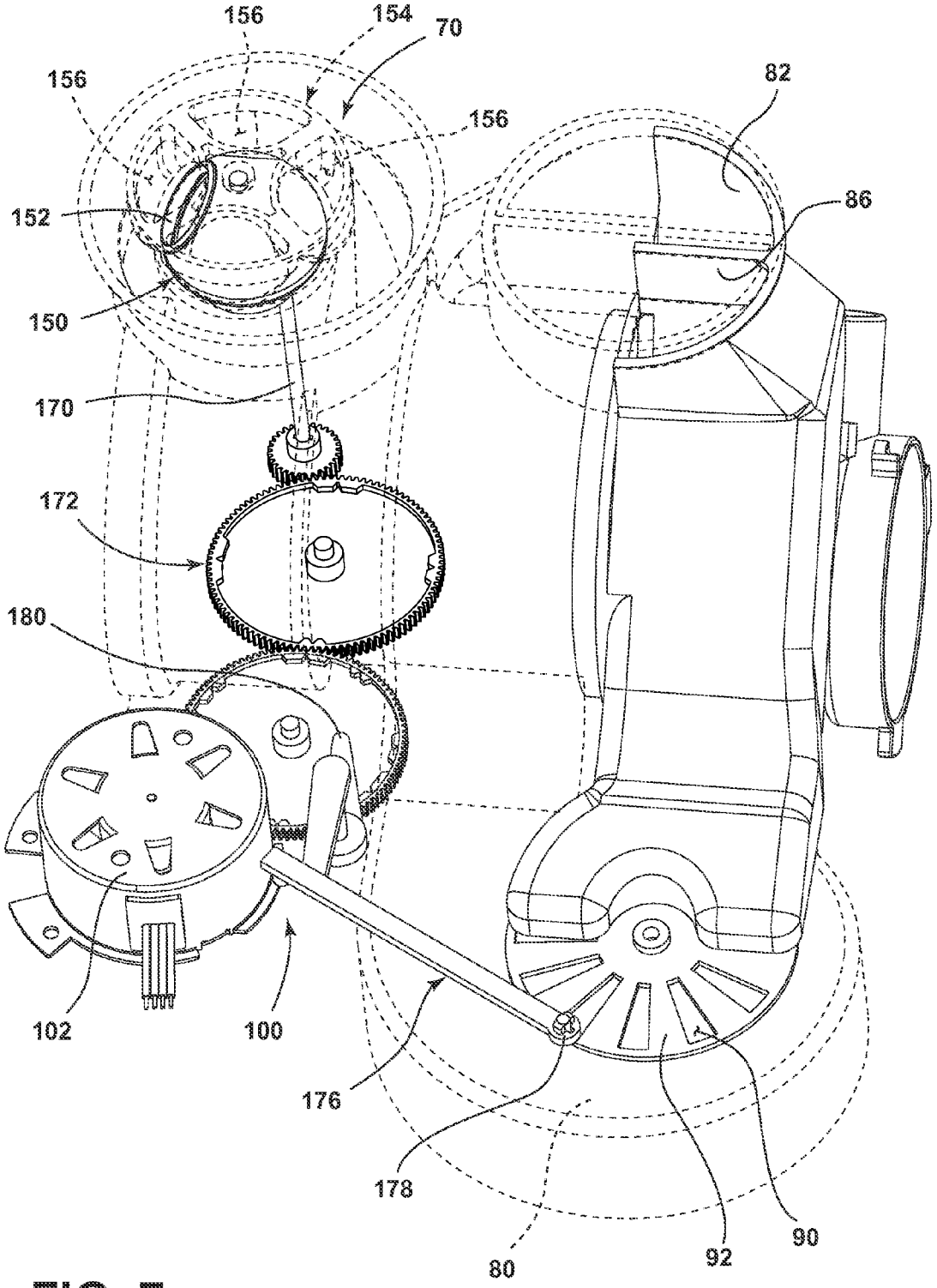
FIG. 7 is a perspective view of a portion of the remote sump and filter unit of FIG. 4.

As illustrated in FIG. 7, the drive system 100 having a single motor 102 is operably coupled to the liquid hemispherical seal 150 and the blower shutter 92 to control the position of both the single opening 152 of the hemispherical seal 150 and the position of the blower shutter 92. While the drive system 100 may include any suitable couplings to the liquid diverter 70 and the blower shutter 92 an exemplary coupling will be described.

In the exemplary embodiment, the drive system 100 includes a drive shaft 170 coupled between the motor 102 and the hemispherical seal 150 and which uses the power from the motor 102 to drive the rotation of the hemispherical seal 150. More specifically, the drive shaft 170 is operably coupled to the hemispherical seal 150 and an output of a gear train 172, which couples to an output of the motor 102. The motor 102 may thus cause the gear train 172 to rotate which in turn causes the drive shaft 170 and the hemispherical seal 150 to rotate. The hemispherical seal 150 may be rotated by the drive system 100 between multiple positions to selectively divert liquid flowing from the recirculation pump 54 between the spray assemblies 44-50.

The drive system 100 also includes a cam mechanism 176 coupled between the motor 102 and the blower shutter 92 and which uses the power from the motor 102 to change the position of the blower shutter 92. More specifically, a first end 178 of the cam mechanism 176 is operably coupled to the blower shutter 92 and a second end 180 of the cam mechanism 176 couples to an output of the motor 102. The motor 102 may thus cause the movement of the cam mechanism 176 which in turn causes the position of the blower shutter 92 to change.

The motor 102 may be bi-directional and the gear train 172 and cam mechanism 176 may be operably coupled to the output of the motor 102 such that they may be moved when the motor 102 is operated in either direction. The drive system 100 may include a suitable sensor for determining the location of the gear train 172, the drive shaft 170, the hemispherical seal 150, and/or the cam mechanism 176. For example, it is contemplated that a position sensor may provide feedback regarding the position of the opening 152. The controller 112 may control the location of the opening 152 based on the signal from the position sensor to direct the liquid to the desired one or more spray assemblies 44-50. Further, a position sensor may be provided to sense the position of the cam mechanism 176 and the controller 112 may control the operation of the drive system 100 based on the output from the position sensor to move the cam mechanism 176 and obtain the desired ratio of ambient air from the inlet and recirculated air from the air return conduit 86. Any suitable position sensor, including an optical sensor and a hall-effect sensor, may be used.

During operation of the dishwasher 10, the liquid recirculation system 38 may be employed to provide liquid to one or more of the spray assemblies 44-50. Liquid in the wash tub 14 passes into the housing 57 where it may collect in the sump 58. At an appropriate time during the cycle of operation to spray liquid into the treating chamber 16, the controller 112 signals the recirculation pump 54 to supply liquid to one or more of the spray assemblies 44-50. The recirculation pump 54 draws liquid from the sump 58 through the filter element 68 and the recirculation pump 54 where it may then be delivered to one or more of the spray assemblies 44-50 through the liquid diverter 70, the supply tube(s) 52, and any other associated valving or diverters.

The movement of the opening 152 relative to the multiple outlets 156 selectively fluidly connects the housing outlet 130 to one or more of the spray assemblies 44-50, which is accomplished by aligning or partially aligning one or more of the opening 152 with one or more of the multiple outlets 156. Activation of the motor 102 of the drive system 100 by the controller 112 turns the gear train 172, which in turn rotates the drive shaft 170 and causes the rotatable hemispherical seal 150 to turn. In this manner, the output from the single motor 102 effects rotation of the hemispherical seal 150. The amount of time that the opening 152 is fluidly connected with each of the multiple outlets 156 controls the duration of time that each of the various spray assemblies 44-50 spray liquid.

After achieving the desired fluid coupling of one or more spray assemblies 44-50 with the recirculation pump 54, the motor 102 may be deactivated so that fluid coupling may be maintained, or may be continued to rotate the drive shaft 170 such that each of the spray assemblies 44-50 is sequentially coupled with the housing outlet 130. During operation, positive pressure of the liquid flowing through the recirculation flow path may press the hemispherical seal 150 against the recirculation manifold 154 such that liquid only flows through the opening 152.

Regardless of whether the air is heated or not, the blower 80 may force air into the wash tub 14. The air travels upward within the treating chamber 16 and exits the treating chamber 16 through the vent 94 or is removed from the treating chamber 16 via air return conduit 86. The blower 80 may draw in air from the air return conduit 86 and/or the inlet depending upon the position of the blower shutter 92. More specifically, the position of the blower shutter 92 controls the ratio of ambient air from the inlet and recirculated air from the air return conduit 86. The blower shutter 92 may be positionable to entirely close off the inlets such that no ambient air is allowed to enter the treating chamber 16.

More specifically openings of the blower shutter may be aligned or partially aligned with openings of the inlet to allow ambient air to be provided to the treating chamber 16. Activation of the motor 102 of the drive system 100 by the controller 112 moves the cam mechanism 176, which in turn causes movement of the blower shutter 92. In this manner, the output from the single motor 102 effects movement of the blower shutter 92. After achieving the desired ratio of ambient to recirculated air, the motor 102 may be deactivated so that ratio may be maintained.

It has been contemplated that the air supply system 40 may be operated while the liquid recirculation system 38 is also being operated. It has also been contemplated that the air supply system 40 may be operated separately to form a drying portion of the operational cycle.

Figure 8:
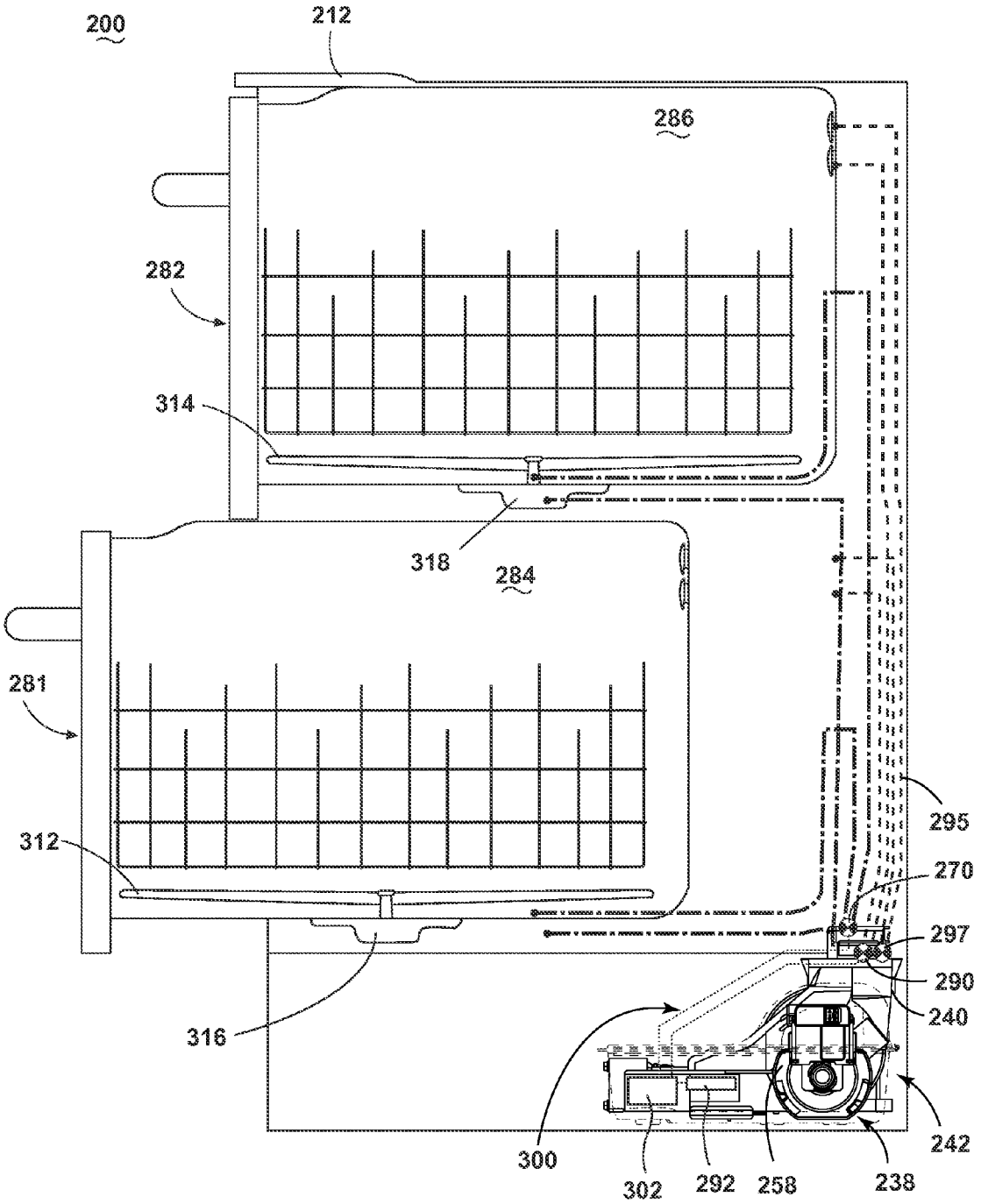
FIG. 8 is a cross-sectional view of a portion of a dishwasher in accordance with a second embodiment of the invention.

FIG. 8 illustrates another embodiment of the invention wherein a remote sump and filter unit 242 is illustrated as being located in a multi-compartment dishwasher 200 having a first compartment or tub 281 and a second compartment or tub 282. In this embodiment, the tubs 281, 282 each partially define a treating chamber 284, 286, respectively. The first and second tubs 281, 282 are moveable elements and take the form of slide-out drawer units of similar size, each having a handle for facilitating movement of the first and second tubs 281, 282 between an open and closed position. The tubs 281, 282 are slidably mounted to a chassis 212 through a pair of extendible support guides (not shown). The upper compartment 282 is illustrated in the closed position and the lower compartment 281 is illustrated in a partially open position. Notably, the remote sump and filter unit 242 is not carried by either drawer and is illustrated as being positioned in the lower-rear portion of the chassis 212.

As with the previously described embodiments, the dishwasher 200 includes a liquid recirculation system 238 selectively fluidly coupled to first treating chamber 284 and the second treating chamber 286 to selectively supply liquid thereto and form a recirculation flow path. A liquid diverter 270 is provided within the recirculation flow path for selectively directing liquid to at least one of the first treating chamber 284 and the second treating chamber 286. The liquid diverter 270 may be any suitable liquid diverter including a hemispherical seal having a single opening as previously described with respect to the second embodiment above. The liquid diverter is configured to include in the recirculation flow path at least one of the tubs. It is also contemplated that either or both of the first and second tubs may include multiple sprayers (not shown) and that the liquid diverter may be configured to include in the recirculation flow path at least one of the multiple sprayers.

It should be noted that each of the first and second tubs 281, 282 have separate liquid inlets 312 and 314, in the form of sprayers, and separate liquid outlets 316 and 318. The liquid inlets 312 and 314 and outlets 316 and 318 are fluidly coupled to the remote sump and filter unit 242 through the recirculation system 238. The remote sump and filter unit 242 includes a housing 257 defining a sump 258 that is physically separate from both of the first and second tubs 281, 282. The sump 258 may receive liquid sprayed into the first treating chamber 284 and the second treating chamber 286. The housing 257 has an inlet 306 fluidly connected to the liquid outlets 316 and 318 when the first and second tubs 281, 282 are in the closed position and an outlet 304, selectively fluidly coupled to the sprayers or liquid inlets 312 and 314 through the liquid diverter 270 when the first and second tubs 281, 282 are in the closed position to define a recirculation path for the sprayed liquid. The remote sump and filter unit 242 may include a drain pump (not shown) and controller 310, as well as a filter unit (not shown) located within the sump 258 and remote from the first and second tubs 281, 282, and other components like the embodiments disclosed above.

An air supply system 240 may selectively fluidly couple to at least one of the first treating chamber 284 and the second treating chamber 286 to selectively supply air thereto. A second diverter 290 for selectively directing air to at least one of the first treating chamber 284 and the second treating chamber 286 may also be included in the dishwasher 200. An air return system 295 has also been illustrated and may include one of more diverters, schematically illustrated as 297. As with the earlier embodiments the air supply system 240 may include a blower 280 having a selectively positionable blower shutter 292 for controlling a ratio of air from the air return system 295 and an inlet open to ambient air.

A drive system 300 having a single motor 302 may be operably coupled to the first diverter 270 and the second diverter 290 to control the positions of the first and second diverters 270 and 290. The blower shutter 292 may also be operably coupled to the drive system 300 to selectively control the position of the blower shutter 292. It is contemplated that the drive system 300 may independently control the position of the first diverter 270, second diverter 290, and the position of the blower shutter 292.

Figure 9:
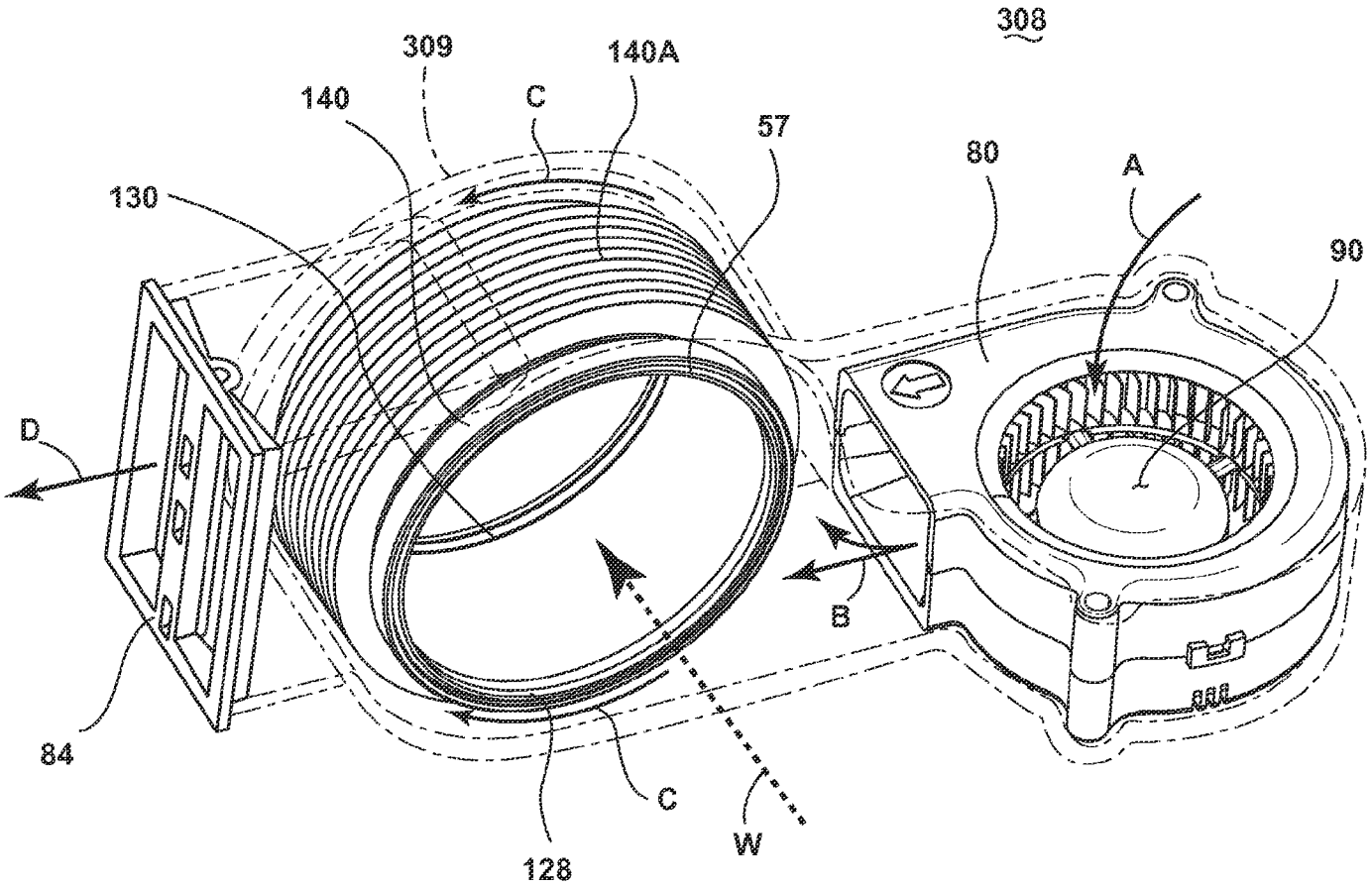
FIG. 9 is a perspective view of the blower, housing, and heater generally as illustrated in FIG. 4, showing a shroud in phantom, airflow around the heater within the shroud, and liquid flow through the housing.

FIG. 9 illustrates an exemplary portion of the liquid recirculation system 38 and air supply system 40 generally discussed previously herein with respect to FIGS. 4 and 5 consisting of an air/liquid heater assembly 308. The assembly 308 includes the blower 80, the housing 57 serving as a thermal transfer interface, the heater 140, the outlet 84, and a shroud 309. Air (represented by airflow vector A) can be drawn by operation of the blower 80 into the center of a rotating turbine 80A which can expel the air radially outwardly (airflow vector B). The air can then enter a conduit portion between the housing 57 and the shroud 309 to flow around the housing 57 (airflow vector C).

The heater 140 can include an array of spaced fins 140A encircling the housing 57. Air from the blower 80 can flow along, i.e. parallel to, the fins 140A to be heated by the heater 140. The air can then exit the heater 140 through the outlet 84 (airflow vector D) to continue through the air supply system 40 into the treating chamber 16. While the exit 84 is shown on the rear side of the heater 140, opposite the exit from the blower 80, the exit 84 may be located anywhere, including at the top of the heater 140.

Wash liquid flowing through the liquid recirculation system 38 can flow (flow vector W) through a conduit portion, e.g. through the housing 57, in a direction transverse to the general direction of airflow around the housing 57. The heater 140 can heat the wash liquid as it passes through the housing 57. The heater 140 can be selectively controlled by the controller 112 to only heat air, only heat wash liquid, or heat air and wash liquid concurrently. A filter element 68 such as the previously-described exemplary rotating filter can be integrated into the housing 57 so that wash liquid can be filtered as it passes through the housing 57.

FIGS. 10-19 illustrate a portion of the liquid recirculation system 38 and air supply system 40 in the form of a unitary air/liquid delivery module 320 comprising an exemplary third embodiment of the invention. It should be understood that the exemplary embodiments described herein may share similar elements, features, and functions. Therefore, like elements and features may be identified with like reference characters unless otherwise noted. It should also be understood that like elements and features can perform their associated functions in a like manner unless otherwise noted. Finally, the unitary air/liquid delivery module 320 is described hereinafter for use in a single treating chamber dishwasher. However, it can be utilized in a dishwasher having more than a single treating chamber, with suitable modifications to the unitary air/liquid delivery module 320 to adapt the module 320 to more than a single treating chamber.

Figure 10:
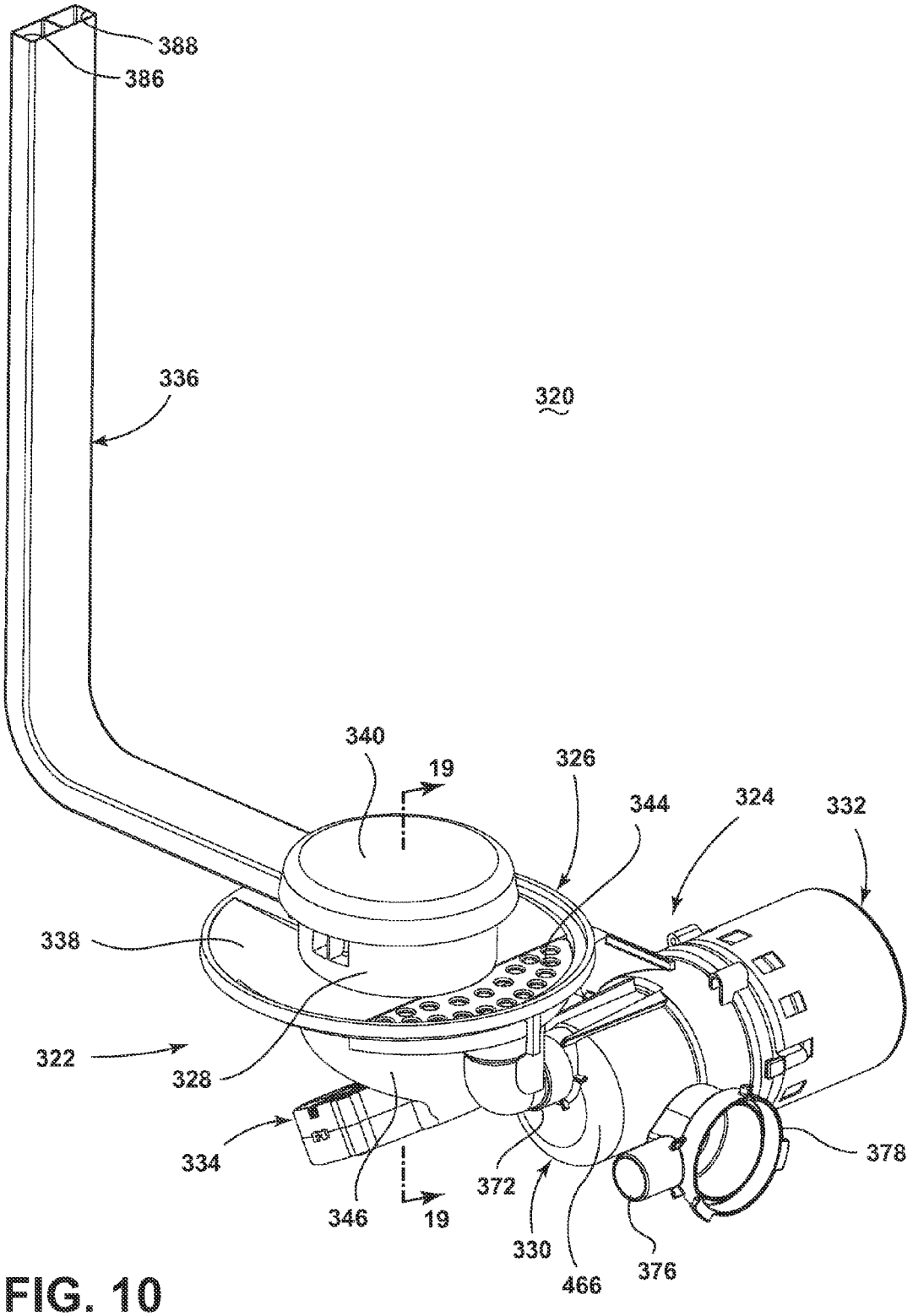
FIG. 10 is a top perspective view of a unitary air/liquid delivery module including a drying air and wash liquid heater assembly in accordance with a third embodiment of the invention.

Referring specifically to FIG. 10, the exemplary unitary air/liquid delivery module 320 can comprise a drying air assembly 322 and a liquid circulation assembly 324. The liquid circulation assembly 324 can include a sump assembly 326, a heater assembly 328, a pump assembly 330, a motor assembly 332, and a sump wash liquid feed tube 336 fluidly coupled with the sump assembly 326 for delivering wash liquid to a treating chamber (not shown). The drying air assembly 322 can include the heater assembly 328 and a blower assembly 334.

Figure 11:
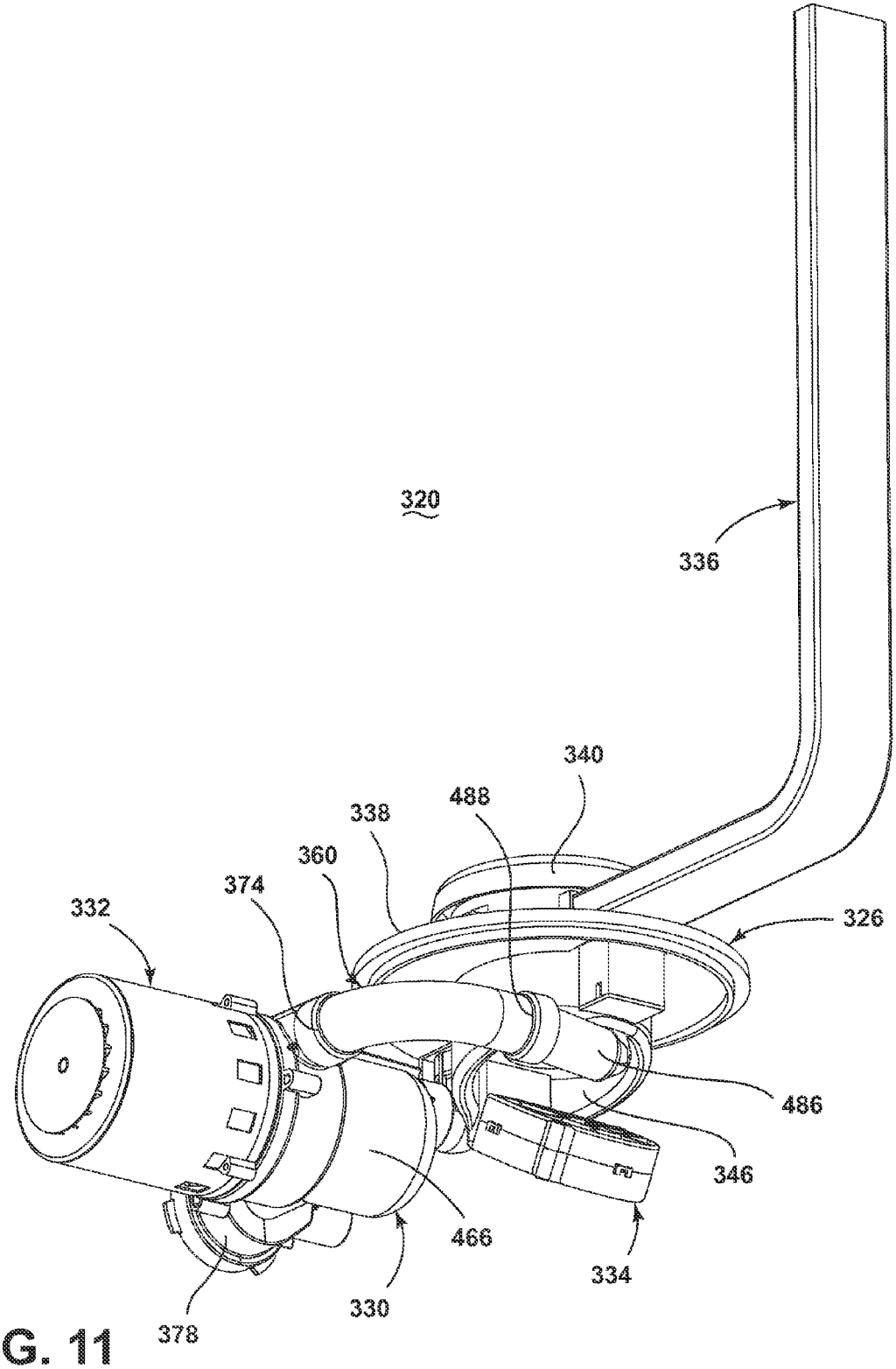
FIG. 11 is a bottom perspective view of the unitary air/liquid delivery module illustrated in FIG. 10.
Figure 12:
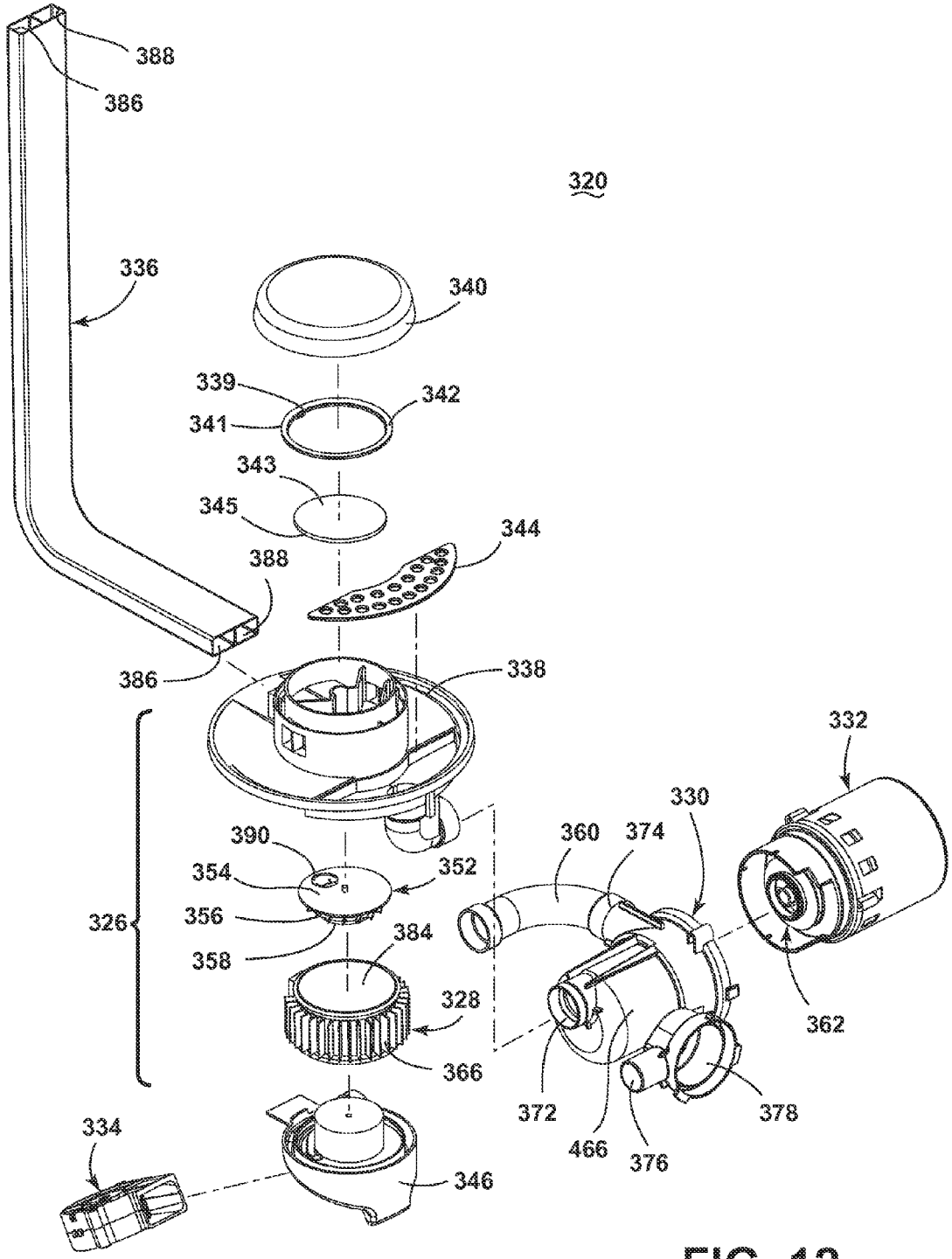
FIG. 12 is an exploded view of the unitary air/liquid delivery module illustrated in FIG. 10.

Referring also to FIGS. 11 and 12, the pump assembly 330 can include a somewhat cylindrical hollow pump housing 466 adapted for liquid-tight coupling with the motor assembly 332. The pump assembly 330 can include an inflow port 372 for receiving wash liquid from the sump assembly 326, an outflow port 374 for coupling with the lower sump housing 346, and a drain port 376 fluidly coupled with a drainage pump housing 378 for drainage of wash liquid from the sump assembly 326 through the pump assembly 330 to a drain or other receptacle. The outflow port 374 can be fluidly coupled with a 90° pump elbow 360. The motor assembly 332 can be operatively coupled with the pump assembly 330. The motor assembly 332 can include a rotating shaft (not shown) supporting a pump impeller assembly 362. When the motor assembly 332 can be coupled with the pump assembly 330, the pump impeller assembly 362 can be received within the pump housing 466.

Figure 13:
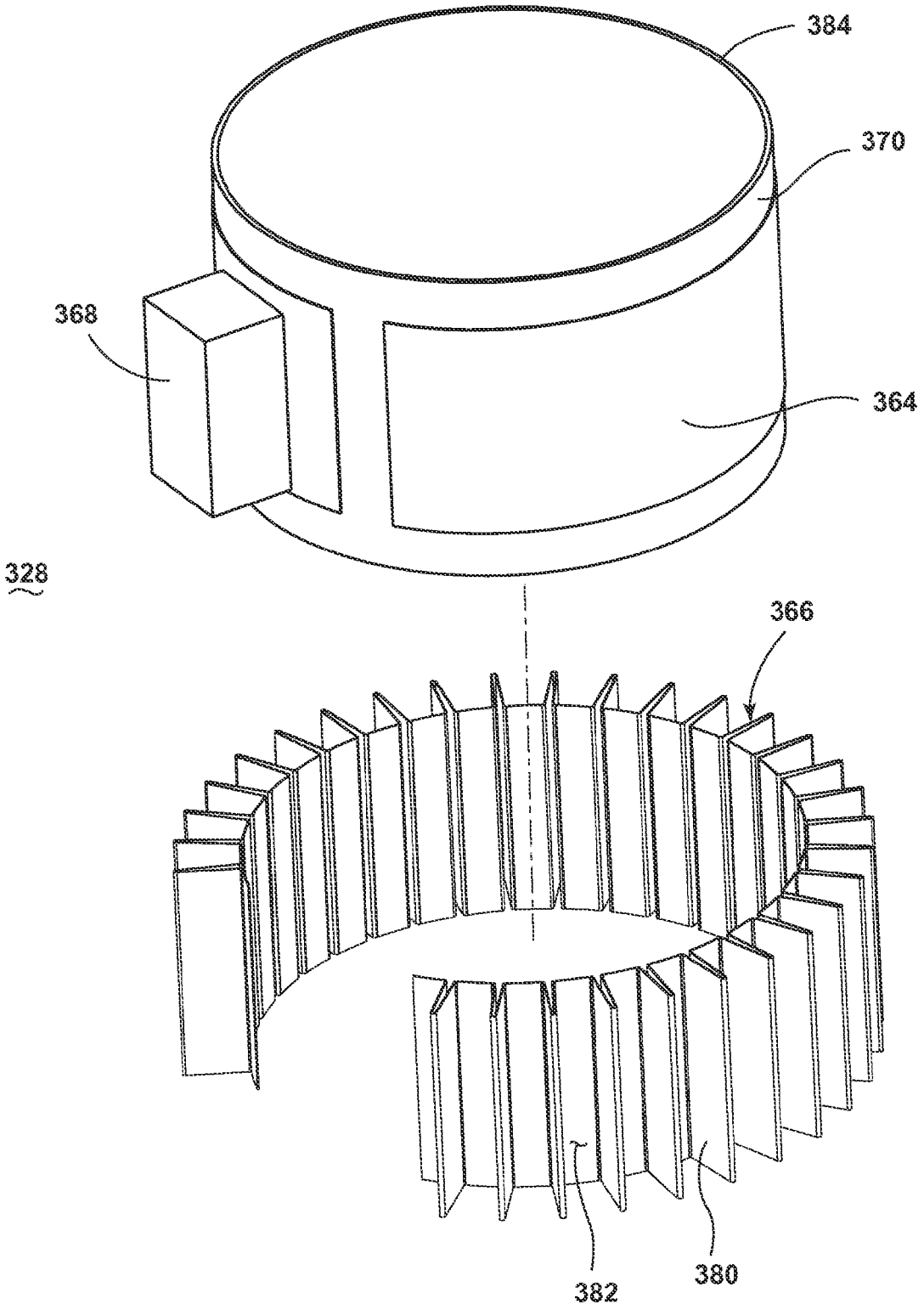
FIG. 13 is an exploded view of a heater assembly comprising part of the unitary air/liquid delivery module illustrated in FIG. 10.

FIG. 13 illustrates the heater assembly 328 including a thick-film heating element 364 integrally attached to an outer surface of a heater sleeve 370 serving as a thermal transfer interface. The heater sleeve 370 can be a tubular body 384 which can be fluidly coupled into the liquid circulation assembly 324. The thick-film heating element 364 can be electrically coupled with a heater power coupler 368 which can, in turn, be electrically coupled with the controller 112 for controlling the operation and performance of the thick-film heating element 364. An axial fin array 366 can be a cylindrical structure for wrapping around the heater sleeve 370 and thick-film heating element 364. The axial fin array 366 can be a regularly-spaced plurality of longitudinally-disposed rectangular thin plates 380, each adjacent pair of plates 380 defining an airflow channel 382 therebetween.

Figure 14:
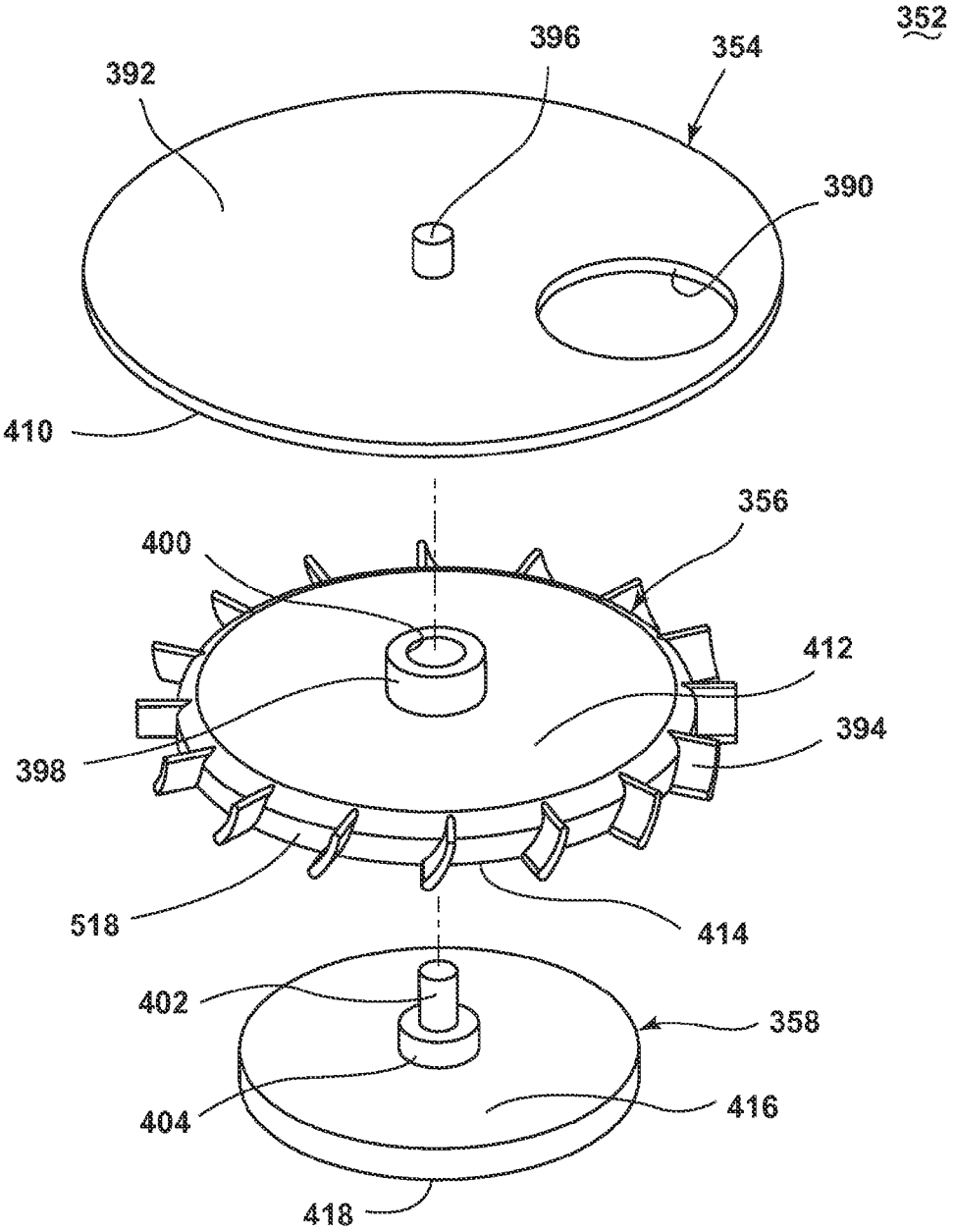
FIG. 14 is an exploded view of a sump turbine disc assembly comprising part of the unitary air/liquid delivery module illustrated in FIG. 10.
Figure 19:
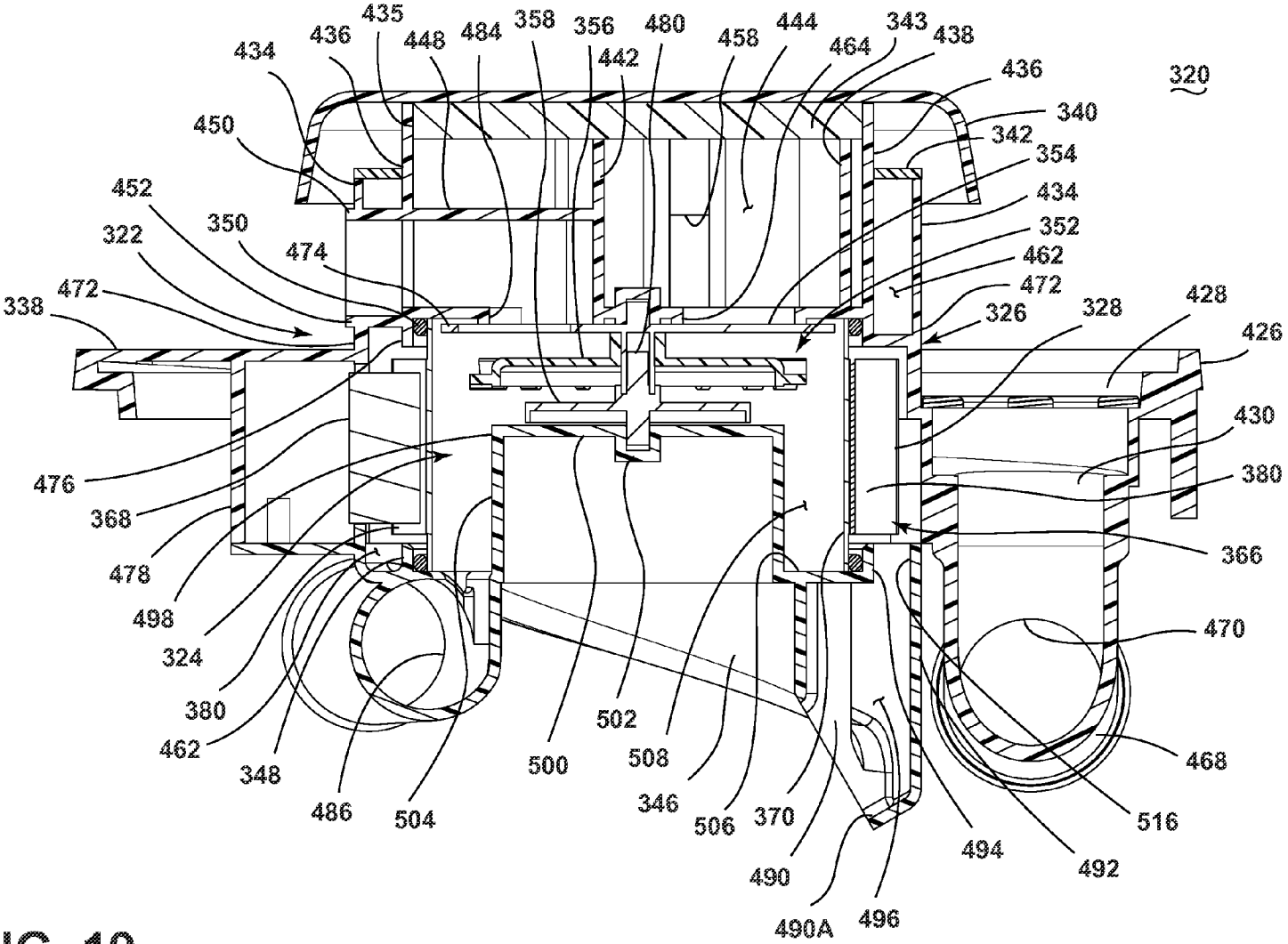
FIG. 19 is a vertical sectional view taken along view line 19-19 illustrated in FIG. 10.

Referring again to FIGS. 11 and 12, the sump assembly 326 can include a sump 338, a sump hood 340, a check valve 342, a liquid chamber cap 343, a sump screen 344, a lower sump housing 346, and a sump turbine disc assembly 352. Referring also to FIGS. 14 and 19, the check valve 342 can have a flat annular body having an inner cylindrical edge 339 and an outer flange edge 341. The liquid chamber cap 343 can have a flat, circular plate-like body having a circumferential cap edge 345.

The sump turbine disc assembly 352 can include a sump diverter disc 354, a sump turbine 356, and a sump indexer disc 358. The sump diverter disc 354 can be a thin circular plate-like body with a diverter obverse surface 392 and an opposed diverter reverse surface 410. A diverter stub axle 396 can extend coaxially away from and orthogonal to the diverter obverse surface 392. A circular diverter opening 390 can penetrate the diverter disc 354, for example, adjacent the disc circumference.

The sump turbine 356 can be a thin circular plate-like body with a turbine obverse surface 412 and an opposed turbine reverse surface 414. The turbine obverse surface 412 can transition orthogonally toward the reverse surface 414 into a circumferential wall 518 supporting a plurality of radially-disposed impeller vanes 394 regularly spaced along the circumferential wall 518. A cylindrical sleeve-like turbine collar 398 can extend coaxially away from and orthogonal to the obverse surface 412 for engagement with a stub axle (concealed) extending coaxially away from and orthogonal to the diverter reverse surface 410. A turbine aperture 400 can extend coaxially through the turbine collar 398.

The sump indexer disc 358 can be a thin circular plate-like body having an indexer obverse surface 416 and an opposed indexer reverse surface 418. The obverse surface 416 can transition orthogonally toward the reverse surface 418 into a circumferential wall 520. A cylindrical spacer 404 can extend coaxially away from the obverse surface 416, transitioning coaxially into a cylindrical stub axle 402. The diameter of the spacer 404 can be greater than the diameter of the stub axle 402. The transition of the spacer 404 to the stub axle 402 can define a circular shoulder. The stub axle 402 can be received in the turbine aperture 400, with the reverse surface 414 in slidable contact with the circular shoulder to space the sump turbine 356 away from the indexer disc 358 by the spacer 404.

The stub axle (concealed) extending coaxially away from and orthogonal to the diverter reverse surface 410 can be configured to pass through the turbine aperture 400 for fixed coupling with the cylindrical stub axle 402. Thus, rotation of the sump indexer disc 358 can be accompanied by synchronous rotation of the sump diverter disc 354. The sump turbine 356 can rotate independently of the rotation of the sump indexer disc 358 and the sump diverter disc 354.

Figure 15:
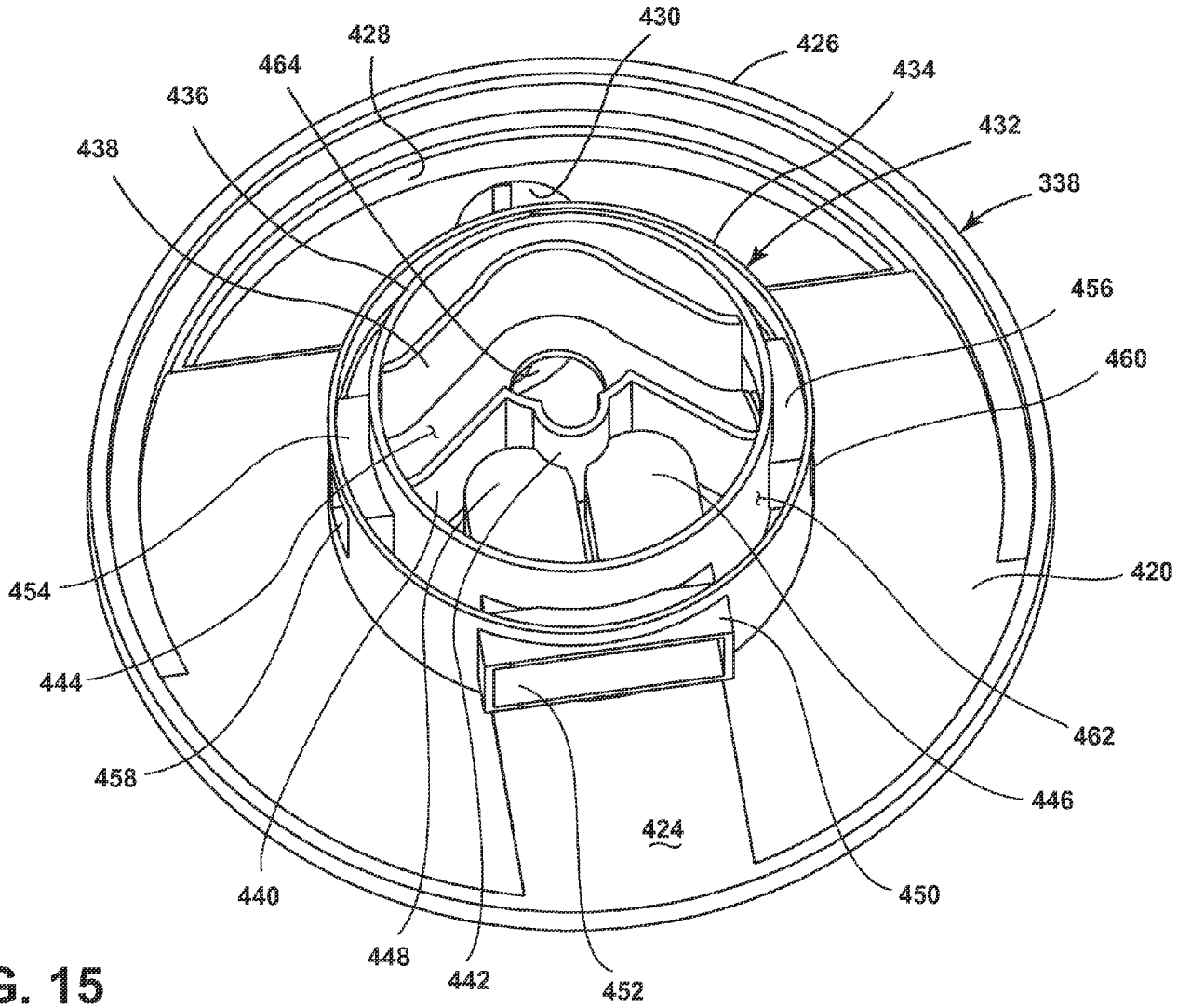
FIG. 15 is a top perspective view of a sump comprising part of the unitary air/liquid delivery module illustrated in FIG. 10.
Figure 16:
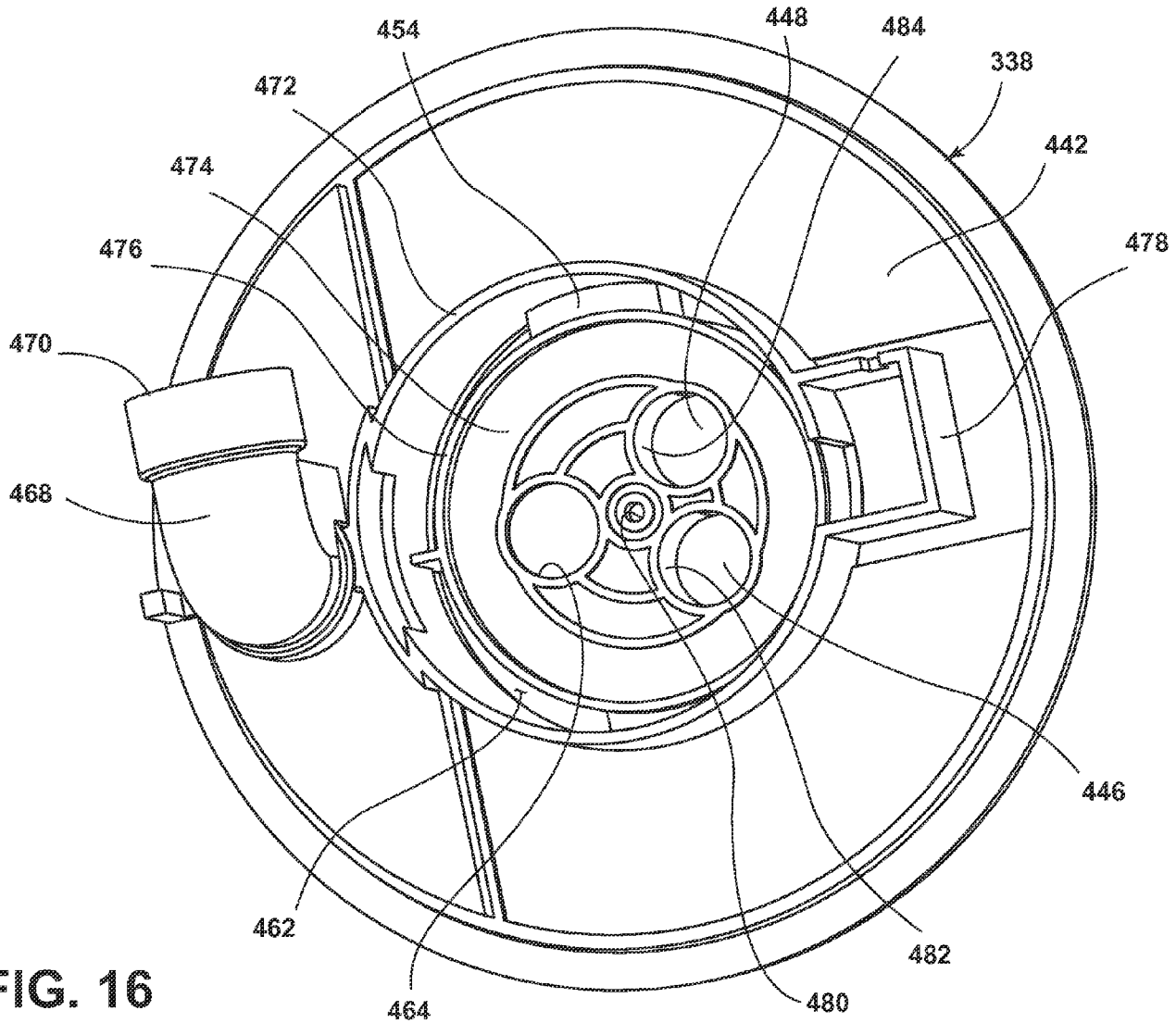
FIG. 16 is a bottom perspective view of the sump illustrated in FIG. 15.

Referring now to FIGS. 15 and 16, the sump 338 can be a generally circular irregularly-profiled body having a sump obverse side 420 and an opposed sump reverse side 422. The center of the obverse side 420 can be occupied by an air/liquid channelway structure 432 extending orthogonally away from the sump obverse side 420. A circumferential wall 426 can extend at least partly around the obverse side 420. An inclined surface 424 can extend between the circumferential wall 426 and the air/liquid channelway structure 432, and can transition to a truncated sector-shaped funnel 428. The funnel 428 can slope to a circular flow port 430 for receiving wash liquid flowing from the sump 338. The circular flow port 430 can open into a 90° elbow-shaped sump outflow conduit 468 extending away from the sump reverse side 422. The sump outflow conduit 468 can have a sump outflow conduit port 470.

The air/liquid channelway structure 432 can be a generally cylindrical structure concentrically extending orthogonally away from the sump obverse side 420. The channelway structure 432 can have an outer annular wall 434 and an inner annular wall 436 defining an airflow annulus 462. The check valve 342 and the inner cylindrical edge 339 can be configured so that the inner cylindrical edge 339 can slidably engage the outside surface of the inner annular wall 436, and the outer flange edge 341 can be disposed concentrically with the outer annular wall 434. The liquid chamber cap 343 can be configured with a diameter somewhat smaller than the inside diameter of the inner annular wall 436 so that the cap edge 345 can sealingly engage the inside surface of the inner annular wall 436. A first outflow conduit 454 and a second outflow conduit 456 can extend from the inner annular wall 436 to the outer annular wall 434 in diametric juxtaposition.

A somewhat V-shaped channel wall 438 can extend across an arc of the inner annular wall 436 to join one end of the arc at a first edge of the first outflow conduit 454, and a second end of the arc at a first edge of the second outflow conduit 456. A somewhat W-shaped channel wall 440 can extend from a second edge of the first outflow conduit 454 to a second edge of the second outflow conduit 456 to define with the V-shaped channel wall 438 a curved channelway 444 fluidly coupling the first outflow port 458 with the second outflow port 460. The floor of the channelway 444 can be penetrated by a circular channelway inflow port 464. The W-shaped channel wall 440 can transition at its midpoint to a partial collar 442. The channelway inflow port 464 can be fluidly coupled with the first outflow port 458 and the second outflow port 460.

A first outflow conduit 446 and a second outflow conduit 448 can extend from the W-shaped channel wall 440, straddling the partial collar 442, in parallel side-by-side registry. The outflow conduits 446, 448 can transition to a liquid feed tube collar 450 defining a liquid feed tube port 452.

As shown in FIG. 16, the outflow conduits 446, 448 can terminate in a first outflow conduit inflow port 482 and a second outflow conduit inflow port 484, respectively. An outer annular wall 472 coextensive with the outer annular wall 434 extending from the sump obverse side 420 can extend orthogonally away from the sump reverse side 422. An inner annular wall 476 coextensive with the inner annular wall 436 extending from the sump obverse side 420 can extend orthogonally away from the sump reverse side 422. The inner annular wall 476 can define and encircle a disc surface 474 in which the first outflow conduit inflow port 482 and second outflow conduit inflow port 484 can be located. A plain bearing 480 can be formed in the center of the disc surface 474. A power coupler chamber 478 can extend radially away from the outer annular wall 472 to house the heater power coupler 368.

Figure 17:
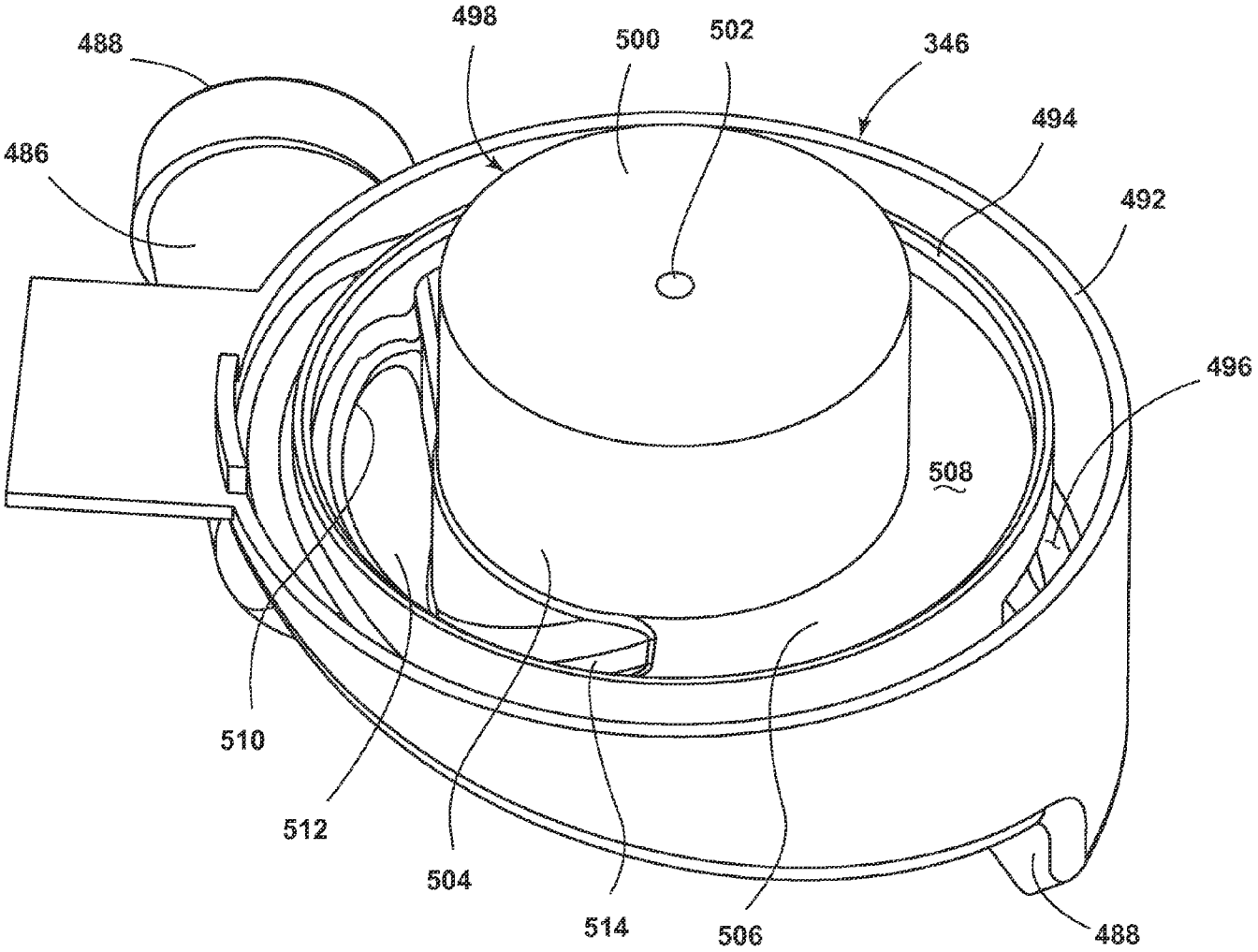
FIG. 17 is a top perspective view of a lower sump housing comprising part of the unitary air/liquid delivery module illustrated in FIG. 10.
Figure 18:
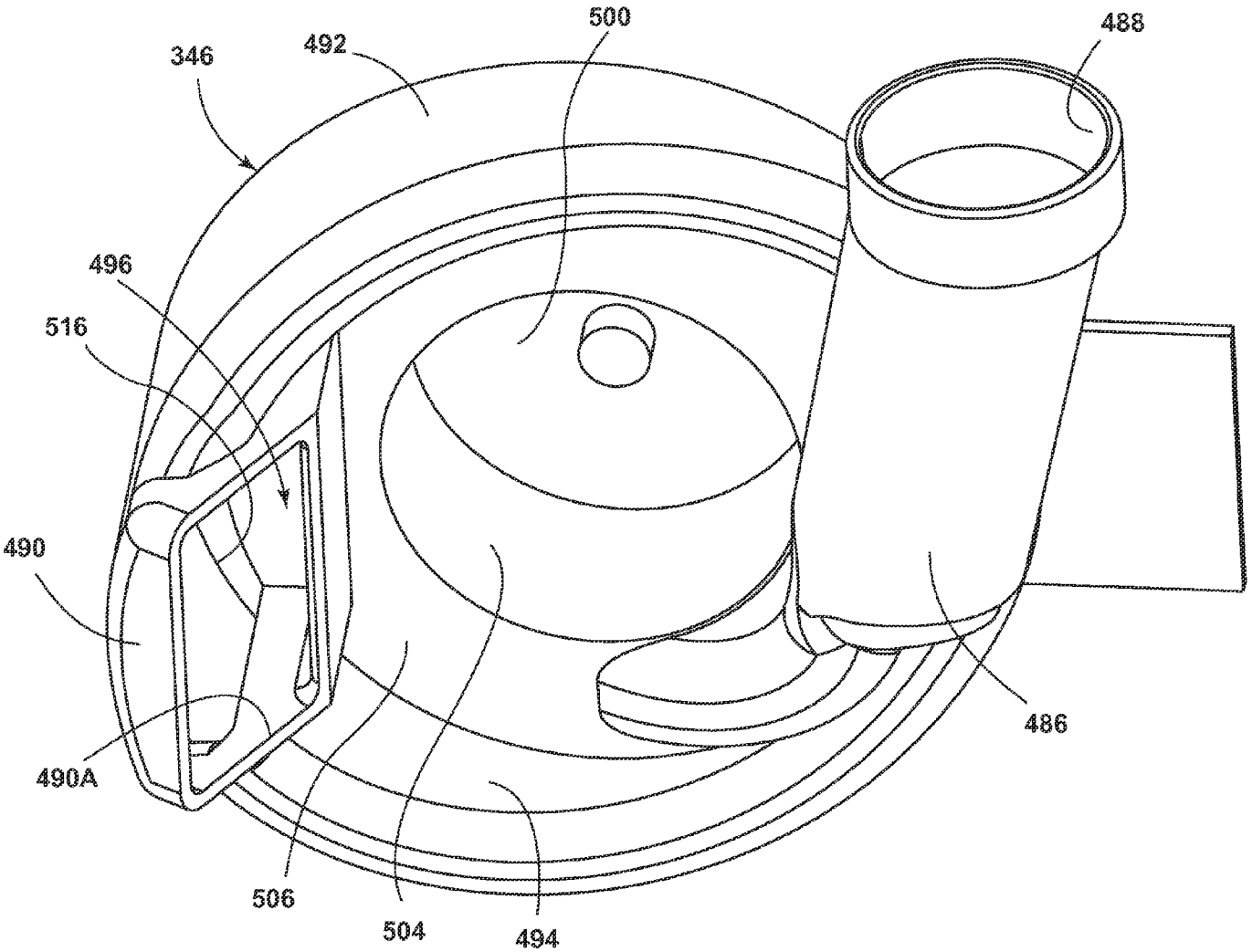
FIG. 18 is a bottom perspective view of the lower sump housing illustrated in FIG. 17.

FIGS. 17 and 18 illustrate the lower sump housing 346 which, in plan view, can be a generally circular body adapted for fluid coupling with the sump 338. The lower sump housing 346 can include an outer annular wall 492 and an inner annular wall 494 in radially-spaced coaxial disposition. The annular walls 492, 494 can define an annular airflow chamber 496 therebetween. The inner annular wall 494 can encircle a cylindrical diverter column 498 in radially-spaced coaxial disposition to partially define an annular liquid flow chamber 508 therebetween having an annular surface 506.

The annular airflow chamber 496 can be fluidly coupled with an air inflow conduit 490 having an air inflow conduit port 490A. The fluid coupling of the annular airflow chamber 496 with the air inflow conduit 490 can define an air outflow port 516. A liquid inflow conduit 486 can somewhat tangentially engage the lower sump housing 346, and can define a liquid inflow conduit port 488. The liquid inflow conduit 486 can transition into an annular channelway opening 510 and an inflow transition channel 512, which can transition to an inflow transition floor 514.

The cylindrical diverter column 498 can extend concentrically away from the annular surface 506 to define a cylindrical diverter column wall 504 and a diverter support surface 500. A plain bearing 502 can be formed concentrically in the diverter support surface 500.

Referring now to FIG. 19, the assembly and operation of the unitary air/liquid delivery module 320 will be described. Starting at the bottom of the illustration and proceeding upward, the lower sump housing 346 can be coupled with the heater assembly 328. Specifically, the lower rim of the heater sleeve 370 can be aligned for contact with the annular surface 506 and the inner wall 494. A first O-ring 348 can encircle the heater sleeve 370 to elastically engage the annular surface 506 and inner wall 494, thereby creating a liquid-tight joint.

The sump 338 can be coupled with the heater sleeve 370 in a similar manner. The upper rim of the heater sleeve 370 can be aligned for contact with the disc surface 474 and the inner annular wall 476. A second O-ring 350 can encircle the heater sleeve 370 to elastically engage the disc surface 474 and inner annular wall 476, creating a liquid-tight joint. The sump turbine disc assembly 352 can then be placed into the heater sleeve 370, and rotationally coupled with the diverter axle bearing 502 and the center bearing 480.

As illustrated in FIG. 19, the liquid chamber cap 343 can be sealed to the inner annular wall 436 through a suitable means, such as O-rings, adhesives, the use of plastic welding techniques, and the like, to fluidly isolate the cylindrical chamber within the inner annular wall 436 from the space outside the inner annular wall 436. Alternative configurations can be utilized, such as the cap 343 extending over the upper edge of the wall 436 and sealed thereto. Alternatively, the cap 343 can be provided with a circumferential stepped flange so that the cap 343 can rest within the inner annular wall 436, as illustrated in FIG. 19, but with the stepped flange extending from the top surface of the cap 343 and over the upper edge of the inner annular wall 436.

The liquid chamber cap 343 can be fixedly coupled with the underside of the sump hood 340 to secure the sump hood 340 to the air/liquid channelway structure 432, or can be integrally formed with the sump hood 340 to define a single component. In either case, the sump hood 340 can be fixedly coupled with the air/liquid channelway structure 432.

The check valve 342 can be slidably coupled with the inner annular wall 436 so that the circumferential inner cylindrical edge 339 can slidably engage the outside surface of the inner annular wall 436. The check valve 342 can extend over the upper edge of the outer annular wall 434 to close the airflow annulus 462. However, the check valve 342 is not sealed to the outer annular wall 434. This can enable the check valve 342 to slidably move along the inner annular wall 436 alternately away from and toward the airflow annulus 462. It should be evident that the liquid chamber cap 343 should not extend beyond the inner annular wall 436 to avoid any interference with the movement of the check valve 342.

Similar to the liquid chamber cap 343, the check valve 342 can alternatively be provided with a circumferential stepped flange so that the check valve 342 can rest within rather than over the outer annular wall 434, but with the stepped flange extending from the top surface of the check valve 342 and over the upper edge of the outer annular wall 434.

When the blower 334 is operating, the resultant air pressure in the airflow annulus 462 can move the check valve 342 away from the airflow annulus 462 to enable airflow into the interior of the sump hood 430. Air can then exit from beneath the sump hood 430 along the circumference. When the blower 334 is not operating, the check valve 342 can sit upon the outer annular wall 434 so that little or no air can flow into or out of the airflow annulus 462. The check valve 342 can be joined with the inner annular wall 436 to prevent air from escaping from the air/liquid delivery module 320 and, in turn, from the treating chamber 16.

The sump outflow conduit port 470 can be fluidly coupled with the inflow port 372. The liquid inflow conduit port 488 can be fluidly coupled with the pump elbow 360, which can in turn be fluidly coupled with the outflow port 374. The blower assembly 334 can be fluidly coupled with the air inflow conduit port 490A.

Heating of air and wash liquid can be done utilizing the single heater assembly 328, with the air and wash liquid flowing in parallel along the inner and outer surfaces of the heater sleeve 370. During a cycle of operation requiring the circulation of wash liquid through the liquid circulation assembly 324, wash liquid can circulate from the outflow port 374, through the pump elbow 360, and into the liquid inflow conduit port 488. The wash liquid can continue through the inflow transition channel 512 into a first conduit portion, i.e. the annular liquid flow chamber 508. The wash liquid can then flow upwardly around the diverter column 498 to engage the sump turbine disc assembly 352. The flow of wash liquid into and through the liquid inflow conduit port 488, the inflow transition channel 512, and the annular liquid flow chamber 508 can introduce turbulence in the wash liquid. This turbulence can be mitigated by the controlled rotation of the sump turbine 356. As the wash liquid flows through the annular liquid flow chamber 508, the heater assembly 328 can be selectively actuated to heat the wash liquid.

Depending on the position of the sump diverter disc 354, specifically the diverter opening 390, wash liquid can flow through the channelway inflow port 464, or alternatingly through both the first and second outflow conduit inflow ports 482, 484. Alternatively, the diverter opening 390 can be positioned so that the channelway inflow port 464, the first outflow conduit inflow port 482, and the second outflow conduit inflow port 484 are blocked.

When the diverter opening 390 is aligned with the channelway inflow port 464, wash liquid can flow through the curved channelway 444 to exit the first outflow port 458 and the second outflow port 460 onto the inclined surface 424. When the diverter opening 390 is aligned with one of the outflow conduit inflow ports 482, 484, wash liquid can flow into the corresponding one of the outflow conduits 446, 448 and through the corresponding one of the liquid pipes 386, 388 to the treating chamber 16 for treating dishes located therein. For example, a first liquid pipe 386 can be fluidly coupled with the mid-level spray assembly 48, and a second liquid pipe 388 can be fluidly coupled with the upper spray assembly 50. The sump indexer disc 358 can be oscillated at a preselected frequency to alternatingly align the diverter opening 390 with the outflow conduit inflow ports 482, 484 to deliver a constant flow of wash liquid through the liquid pipes 386, 388.

During a drying cycle of operation, air can be delivered from the blower assembly 334 through the air inflow conduit 490 into a second conduit portion, i.e. the airflow annulus 462. As the air flows upwardly, it can pass through the axial fin array 366, parallel with the fins 380. The airflow can be parallel with the general direction of the flow of liquid through the annular liquid flow chamber 508. The air flowing through the airflow annulus 462 can be heated by selectively actuating the heater assembly 328. The air can then exit circumferentially from under the sump hood 340 into the treating chamber 16 for drying dishes located therein.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

The embodiments of the invention described above allow for a variety of benefits including a simple construction, which requires fewer parts to manufacture the dishwasher. The embodiments of the invention described above allow for a single drive system to control a variety of components in the dishwasher, which reduces the cost associated with the manufacture of the dishwasher.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configurations shown in FIGS. 1-19, such as by inclusion of other conduits, dish racks, valves, spray assemblies, seals, and the like, to control the flow of liquid and the supply of air.

What is claimed is:

1. A dishwasher for washing utensils according to an automatic cycle of operation, comprising:

a tub at least partially defining a treating chamber for receiving utensils for cleaning;

a liquid supply system fluidly coupled to the treating chamber and having a pump assembly selectively supplying liquid to the treating chamber, and where the liquid supply system includes a first conduit portion through which the liquid passes as it is supplied to the treating chamber and wherein the first conduit is located within a lower sump housing that is fluidly coupled downstream of an outlet of the pump assembly;

an air supply system fluidly coupled to the treating chamber and selectively supplying air to the treating chamber, and including a second conduit portion through which the air passes, with the first conduit portion at least partially forming the second conduit portion to define a thermal transfer interface between the liquid supply system and the air supply system; and a heating system located within the lower sump housing, comprising:

a film heating element provided on the thermal transfer interface and wherein the film heating element includes a sleeve that at least partially wraps around the first conduit portion to form a tubular in-line heater configured to heat liquid flowing through the first conduit portion; and an axial fin array having a cylindrical structure wrapping around at least a portion of the sleeve of the film heating element and where the axial fin array is thermally coupled to and extending from the film heating element and wherein fins of the axial fin array extend into the second conduit portion such that air flowing through the air supply system passes over the fins whereby the heat in the fins is transferred to the passing air; and wherein activation of the film heating element provides heat to both of the liquid supply system and the air supply system.

2. The dishwasher of claim 1 wherein at least some of the fins are oriented in a first direction aligned with the direction of the flowing air.

3. The dishwasher of claim 1 wherein at least some of the fins are oriented in a first direction non-aligned with the direction of the flowing liquid.

4. The dishwasher of claim 1 wherein the second conduit portion envelopes at least one of the film heating element and the first conduit portion.

5. The dishwasher of claim 1 wherein the film heating element wraps around an exterior of the first conduit portion.

6. The dishwasher of claim 5 wherein the second conduit portion at least partially envelopes both the film heating element and the first conduit portion.

7. The dishwasher of claim 1 wherein the liquid passing through the liquid supply system flows in a first direction and wherein the air supply system comprises a blower having an inlet flow direction non-aligned with the first direction.

8. The dishwasher of claim 7 wherein the first and inlet flow directions are transverse to each other.

9. The dishwasher of claim 8 wherein the fins are aligned in a second direction transverse to the first direction and inlet flow direction.

10. The dishwasher of claim 1 wherein the axial fin array comprises regularly-spaced longitudinally-disposed thin plates with each adjacent pair of plates defining an airflow channel therebetween.

11. The dishwasher of claim 1 wherein the first conduit portion is upstream and physically separated via a conduit from a wash liquid pump housing.

12. The dishwasher of claim 11 wherein the liquid passing through the liquid supply system flows in a first direction and the air flowing through the air supply system flows in a second direction, which is parallel with the first direction.

13. A dishwasher for washing utensils according to an automatic cycle of operation, comprising:

a tub at least partially defining a treating chamber for receiving utensils for cleaning;

a liquid supply system fluidly coupled to the treating chamber and selectively supplying liquid to the treating chamber, and including a first conduit portion through which the liquid passes as it is supplied to the treating chamber;

an air supply system fluidly coupled to the treating chamber and selectively supplying air to the treating chamber, and including a blower and a second conduit portion through which the air passes, with the first conduit portion at least partially forming the second conduit portion to define a thermal transfer interface between the liquid supply system and the air supply system; and a heating system, comprising:

a film heating element provided on the thermal transfer interface and wherein the film heating element at least partially wraps around the first conduit portion to form a tubular in-line heater configured to heat liquid flowing through the first conduit portion; and an axial fin array having a cylindrical structure wrapping around at least a portion of the film heating element and where the axial fin array is thermally coupled to and extending from the film heating element; and wherein activation of the film heating element provides heat to both of the liquid supply system and the air supply system and wherein the liquid passing through the first conduit portion flows in a first direction and the air flowing around the first conduit portion flows in a second direction, which is transverse to the first direction and where the blower has an inlet flow direction that is non-aligned with the first and second directions.

14. A dishwasher for washing utensils according to an automatic cycle of operation, comprising:

a tub at least partially defining a treating chamber for receiving utensils for cleaning;

a liquid supply system fluidly coupled to the treating chamber and selectively supplying liquid to the treating chamber, and including a first conduit portion through which the liquid passes as it is supplied to the treating chamber;

an air supply system fluidly coupled to the treating chamber and selectively supplying air to the treating chamber, and including a second conduit portion through which the air passes, with the first conduit portion at least partially forming the second conduit portion to define a thermal transfer interface between the liquid supply system and the air supply system; and a heating system, comprising:

a sleeve film heating element provided on the thermal transfer interface and wherein the sleeve film heating element at least partially wraps around the first conduit portion to form a tubular in-line heater configured to heat liquid flowing through the first conduit portion; and an axial fin array having a regularly-spaced plurality of longitudinally-disposed rectangular thin plates wrapping around at least a portion of the sleeve film heating element and where the axial fin array is thermally coupled to and extending from the sleeve film heating element; and wherein activation of the sleeve film heating element provides heat to both of the liquid supply system and the air supply system.

* * * * *